US005769411A

United States Patent [19]

Nakagawa et al.

[11] Patent Number: 5,769,411

[45] Date of Patent: Jun. 23, 1998

[54] SHEET FEEDING APPARATUS WITH SHEET SEPARATION FEATURE

[75] Inventors: Tomohito Nakagawa, Tokyo; Noriyoshi Ueda, Yokohama; Masakazu Hiroi, Kawasaki, all of Japan

[73] Assignee: Canon Kabushiki Kaisha, Tokyo, Japan

[21] Appl. No.: 651,239

[22] Filed: May 22, 1996

[30] Foreign Application Priority Data

May 26, 1995 [JP] Japan ..... 7-128148

[51] Int. Cl.[6] ..... B65H 3/52

[52] U.S. Cl. ..... 271/122; 271/121

[58] Field of Search ..... 271/122, 124, 271/125, 121

[56] References Cited

U.S. PATENT DOCUMENTS

| | | | |
|---|---|---|---|
| 4,085,929 | 4/1978 | Tuchiya et al. | 271/122 |
| 4,575,068 | 3/1986 | Kato | 271/122 |
| 4,660,957 | 4/1987 | Ueda et al. | 355/3 |
| 4,858,907 | 8/1989 | Eisner et al. | 271/124 |
| 4,871,162 | 10/1989 | Imai et al. | 271/122 |
| 4,934,683 | 6/1990 | Ueda et al. | 271/3.1 |
| 4,935,775 | 6/1990 | Ueda et al. | 355/202 |
| 5,029,839 | 7/1991 | Kajiwaka et al. | 271/124 |
| 5,132,741 | 7/1992 | Kitajima et al. | 355/309 |
| 5,192,068 | 3/1993 | Parker et al. | 271/125 |
| 5,211,388 | 5/1993 | Walluk | 271/122 |
| 5,431,385 | 7/1995 | Holbrook | 271/122 |

*Primary Examiner*—H. Grant Skaggs

*Attorney, Agent, or Firm*—Fitzpatrick, Cella, Harper and Scinto

[57] ABSTRACT

A sheet feeding apparatus has a separation device including a rotational feeding member rotatable in the direction of sheet feeding and a counter-rotational member rotatable in the direction counter to the sheet feeding direction, and an elastic member disposed in resilient contact with the rotational feeding member in a region near a nip formed between the rotational feeding member and the counter-rotational member, so as to perform sheet separation in cooperation with the rotational feeding member. The leading ends of the sheets delivered from a sheet tray by a delivery roller are staggered in the nip between the rotational feeding member and the elastic member, and the staggered sheets are separated one-by-one in the nip between the rotational feeding member and the counter-rotational member.

21 Claims, 18 Drawing Sheets

SHEET FEEDING APPARATUS WITH SHEET SEPARATION FEATURE

BACKGROUND OF THE INVENTION

1. Field of the Invention

The present invention relates to a sheet feeding apparatus suitable for use in an image forming apparatus such as a copying apparatus, laser beam printer, or the like. The present invention also relates to an automatic original feeding apparatus, as well as to an image reading apparatus, making use of the sheet feeding apparatus.

2. Description of the Related Art

An automatic original sheet feeding apparatus has been known in which original sheets are fed to an image reading section of an image forming apparatus, such as a copying apparatus, from an original sheet stack on an original sheet tray in one-by-one fashion, wherein a separating device is used to separate successive sheets one-by-one from the sheet stack so as to prevent simultaneous feeding of two or more original sheets.

FIG. 20 shows a known separating device of the kind described above. In FIG. 20, the separating device has, in the direction of the arrow A which indicates the sheet feed direction, a crescent-shaped pickup roller 209 rotatable counterclockwise so as to feed the sheets one-by-one from the lowermost sheet of a stack of sheets P on a tray 205, a sheet feeding roller 211, and separation belts 212 arranged on both sides of the sheet feed roller 211 and partially overlapping the sheet feeding roller 211, the separation belts being wound around and stretched between a separation drive pulley 221 and a separation driven pulley 222. In operation, the separation driven pulley 221 rotates counterclockwise so that the separation belts 212 run in such a direction as to push the sheet stack back, i.e., in the direction counter to the sheet feed direction. The sheet contacting surface of the sheet feed roller 211 has a friction coefficient greater than that of the separation belts 212 and is driven at a greater speed than the separation belts. As a consequence, only the lowermost sheet is separated from the stack and fed, while the remainder of the sheets of the stack are retained by the separation belts.

This known separation apparatus suffers from a problem described below with reference to FIG. 21. When the original sheets P are copies or prints produced by a copying apparatus or a laser beam printer with a toner or ink, the toner or the ink carried by the obverse side (upper surface) of the lowermost sheet P1 tends to be transferred to the reverse side (lower surface) of the second sheet P2 which is retained by the separation belts 212 at the separation nip 230, due to strong separation pressure exerted by the separation belts 212 and due to rubbing of the lowermost sheet P1 on the second sheet P2 causing contamination known as "setoff".

SUMMARY OF THE INVENTION

An object of the present invention is to overcome the above-described problem without being accompanied by degradation of separation performance.

To this end, according to one aspect of the present invention, there is provided a sheet feeding apparatus, comprising: sheet supporting means for supporting sheets; sheet delivery means for delivering the sheets from the sheet supporting means; separation means including a rotational feeding member rotatable in a direction of sheet feed and a counter-rotational member rotatable in a direction counter to the sheet feed direction, the separation means separating the sheets delivered by the sheet delivery means; and an elastic member disposed in resilient contact with the rotational feeding member at a position upstream the nip formed between the rotational feeding member and the counter-rotational member, so as to perform the sheet separation in cooperation with the rotational feeding member.

According to another aspect of the present invention, there is provided a sheet feeding apparatus, comprising: sheet supporting means for supporting sheets; sheet delivery means for delivering the sheets from the sheet supporting means; first separation means including a rotational feeding member rotatable in a direction of sheet feed and a counter-rotational member rotatable in a direction counter to the sheet feed direction, the separation means separating the sheets delivered by the sheet delivery means; and second separation means disposed in resilient contact with the rotational feeding member at a position upstream of a nip formed between the rotational feeding member and the counter-rotational member; so as to perform the sheet separation in cooperation with the rotational feeding member; wherein the levels of separating pressures exerted by the first separation means and the second separation means are below a predetermined level of separating pressure.

The present invention also provides an image reading apparatus incorporating a sheet feeding apparatus having the features set forth above.

These and other objects, features and advantages of the present invention will become clear from the following description when the same is read in conjunction with the accompanying drawings.

BRIEF DESCRIPTION OF THE DRAWINGS

FIG. 4(*b*) is an illustration of the arrangement shown in FIG. 4(*a*);

FIG. 4(*c*) is a side elevational view of the shutter device and the original sheet tray of the sheet feeding apparatus of the present invention, in a state in which a sheet is fed through a closed passage;

FIGS. 5(*b*) and 5(*c*) are illustrations of the arrangement shown in FIG. 5(*a*);

FIG. 7(*b*) is a side elevational view of the arrangement shown in FIG. 7(*a*);

FIG. 14(*b*) is a view of the separation device depicted in FIG. 14(*a*) along the arrow X;

DESCRIPTION OF THE PREFERRED EMBODIMENTS

An embodiment of the present invention will be described with reference to the accompanying drawings.

Figure 2:
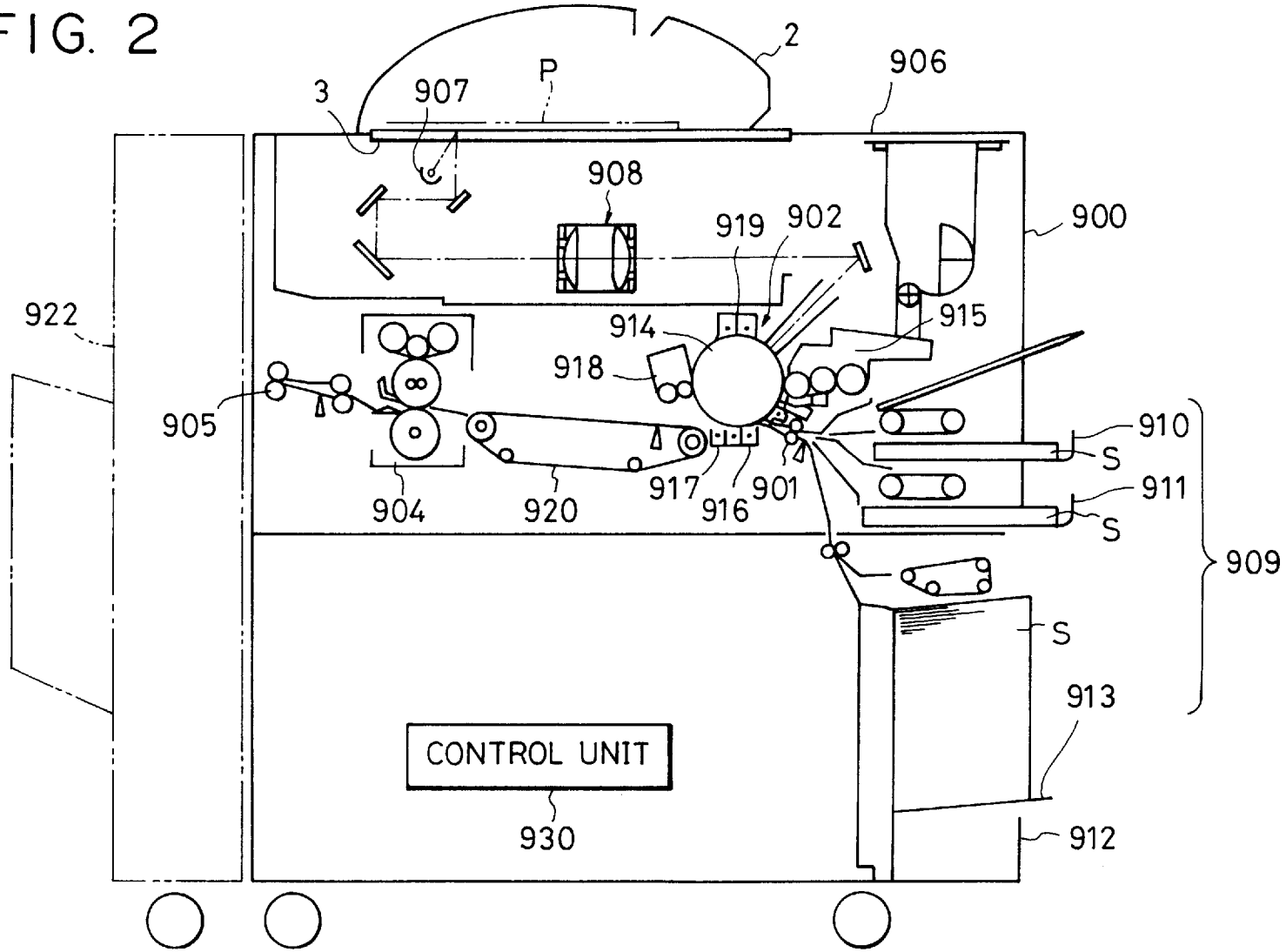
FIG. 2 is a longitudinal sectional view of an image forming apparatus to which the automatic original sheet feeding apparatus of the present invention is applicable.

FIG. 2 is an illustration of an image forming apparatus to which an automatic original sheet feeding apparatus of the present invention can be applied.

The image forming apparatus has a main structure 900 which includes a platen glass 3 as an original reading section, a light source 907 and a lens system 908 constituting a reading section, a sheet feeding section 909, an image forming section 902 and so forth. The apparatus main structure 900 also has an automatic original sheet feeding apparatus 2 which feeds original sheets P in a one-by-one fashion onto the platen glass 3.

The sheet feeding section 909 has cassettes 910, 911 which accommodate stacks of sheets and which are detachably mounted. The sheet feeding section 909 also has a deck 913 disposed on a pedestal 912. The image forming section 902 has a developing device 915 incorporating a cylindrical photosensitive drum 914, a transfer charger 916, a separation charger 917, a cleaner 918, a primary charger 919, and so forth. Disposed downstream of the image forming section 902 are a conveyor device 920, a fixing device 904 and an ejecting roller 905.

Sheets S ejected from the main structure 900 are sorted as necessary, by means of a sheet sorter 922, which is connected to the main structure 900. Various sections and devices in the copying apparatus main structure 900 operate under the control of a control unit (CPU) 930.

The operation of this image forming apparatus is as follows:

A sheet S is fed from the cassette 910 or 911 or from the deck 913, in response to a sheet feed signal given by a control unit 930 provided in the apparatus main structure 900. Meanwhile, light is emitted from the light source 907 so as to be reflected by the original P placed on the platen glass 3, and the reflected light is made to impinge upon the photosensitive drum 914 through the optical system 908. The photo-sensitive drum has been uniformly charged by the primary charger 919 so that an electrostatic latent image is formed on the surface of the drum surface irradiated with the reflected light. The latent image thus formed is changed into a toner image by the developing device 915.

The sheet S fed from the sheet feeding section 909 is sent to the image forming section 902 at a predetermined timed relation to the image formation, by means of the register roller 901, which serves to correct any skew of the sheet S. In the image forming section 902, the toner image is transferred by the operation of the transfer charger 916 from the photosensitive drum 914 to the sheet S which has been sent to this section. The sheet S carrying the toner image transferred thereto is charged by a separation charger 917 with a polarity opposite to that created by the transfer charger 916 so as to be separated from the photosensitive drum 914.

The sheet S thus separated is conveyed by the conveyor device 920 to the fixing device 904 where the transferred image which is still unfixed is permanently fixed. The sheet S carrying the fixed image is ejected from the apparatus main structure 900 by the operation of the ejection roller 905.

Thus, the sheet S which was fed from the sheet feeding section 909, is ejected with an image formed thereon.

A description will now be given of an automatic original sheet feeding apparatus of the present invention.

Figure 1:
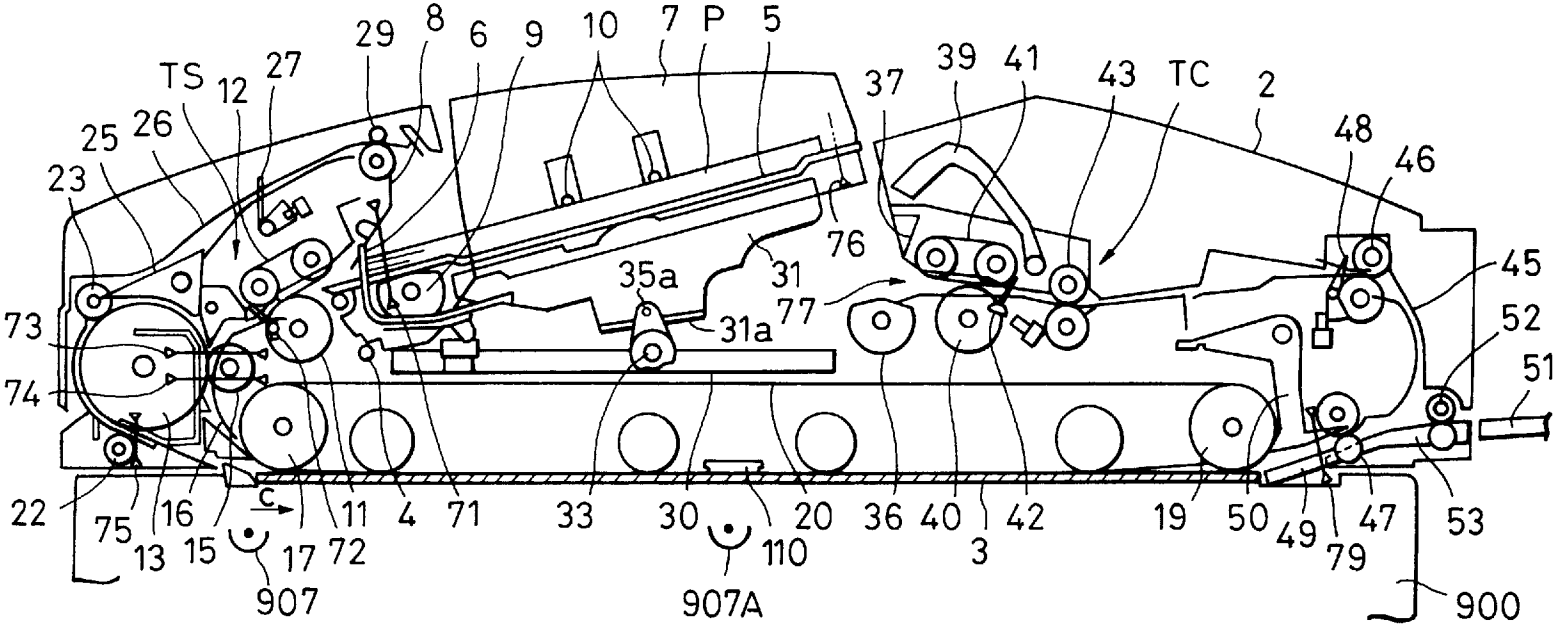
FIG. 1 is a longitudinal sectional view of an automatic original sheet feeding apparatus in accordance with the present invention.

Referring to FIG. 1 which is a longitudinal sectional view of an original sheet feeding apparatus embodying the present invention, an endless reversible conveyor belt 20 wound around and stretched between a driver roller 17 and a driven roller 19 is disposed on the platen glass 3 of the copying apparatus main structure 900.

A stack of a plurality of sheets P is placed on the original sheet tray 5, with the side edges of the sheets regulated in the breadthwise direction by a pair of breadthwise regulating plates. Recycle levers 10 placed on the stack of the sheets P separates the sheets P of the stack which have not yet been fed from the sheets which have already been fed and returned to the original sheet tray 5. Reference numeral 6 designates a shutter (movable means) which stops the leading ends of the original sheets P to register these leading ends. The shutter 6 is retracted to a position below the original sheet tray 5 when the sheets are to be fed. A crescent-shaped delivery roller 9 rotates to engage with the lowermost sheet of the sheet stack so as to feed the lowermost sheet. A pressing member 8 is vertically movable so as to press the stack of the sheets P onto the delivery roller 9.

A separating device disposed downstream of the delivery roller 9 includes a sheet feed roller 11 driven to rotate in the direction of feed of the sheets and a separator belt 12, which runs in the direction counter to the sheet feed direction. The separation device serves to separate the sheets fed by the delivery roller 9 so as to ensure that the sheets P are fed in one-by-one fashion. Disposed downstream of the separation device are a pair of register rollers including a powered turning roller 13 and a cooperating idle roller 15. These register rollers 13, 15 serve to permit the original sheet P to be fed onto the platen glass 3 at a predetermined timing by the operation of a conveyor belt 20. The original sheet P which has been conveyed to and stationed at a predetermined position on the platen 3 is scanned by the light source 907 which moves in the direction of the arrow C, whereby an image on the original sheet P is read in a stationary mode.

A first conveyance passage 16 is constituted by the passage including the separation device 11, 12 and the register rollers 13, 15. A switch back passage TS is constituted by the above-mentioned first conveyance passage 16, the conveyor belt 20, the register roller 13, pinch rollers 22, 23 contacting the register roller 13, and an ejection passage 26. The original sheet P can be switched back and delivered to the reading position through this switch back passage TS.

After the reading in the stationary mode, the original sheet P after the reading is moved back by reversing of the conveyor belt 20 and is conveyed to a flapper 25 along a conveyance passage provided by an outer part of the peripheral surface of the register roller 13. When both sides of the original sheet P are to be read, the flapper 25 turns over the original sheet P and guides the same to the platen glass 3, whereas, when only one side of the original sheet P is to be read, the flapper 25 serves to guide the original sheep P to the ejector roller pair 29 through the ejection passage 26. Reference numeral 27 designates a sensor which senses the original sheet P moving through the ejection passage 26. The original sheet P discharged by the ejector roller pair 29 is sent back to the original sheet tray 5 and is placed on the recycle levers 10 so as to be separated from the stack of the sheets P which have not yet been fed and which are below the recycle lever 10.

Figure 3:
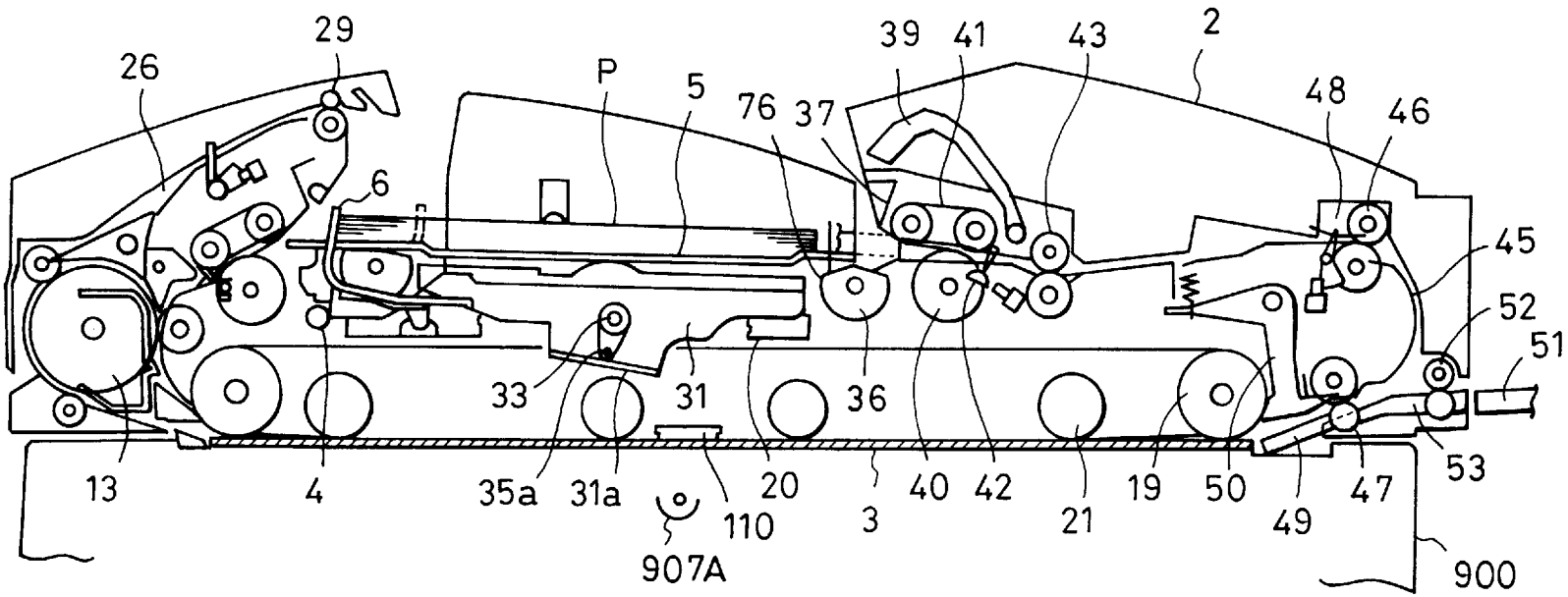
FIG. 3 is an illustration of operation of the automatic original sheet feeding apparatus of the invention a shown in FIG. 1.

The original sheet tray 5 is pivotable about supporting shafts 4 between an inclined position shown in FIG. 1 and a horizontal position shown in FIG. 3, as a result of an operation which will be described later. The arrangement is such that, when the original sheet tray 5 is in the inclined position shown in FIG. 1, the original sheets P are fed and conveyed to the platen glass 3 along the first conveyance passage 16 as described above, whereas, when the original sheet tray 5 is in the horizontal position shown in FIG. 3, the original sheets P are fed to the platen glass 3 by being moved along a second conveyance passage 45 in the opposite direction, i.e., with the rear end of the sheet serving as the leading end.

The above-mentioned second conveyance passage 45, conveyor belt 20 and the ejection passage 26 in combination constitutes a closed passage TC which forms a closed loop of passage along which the original sheet P is fed to the reading position and then discharged. The aforesaid switch back passage TS, conveyor belt 20 and the closed passage TC in cooperation constitute an original sheet conveyance means TS, TC, 20 which feeds and conveys the original sheet P to the reading position and then discharges the same therefrom. Numeral 77 designates a supplying section by from which the original sheet P fed from a delivery roller 36 is supplied to the original sheet conveyance means TS, TC, 20.

Members and components similar to those described above are arranged also on the rear side of the original sheet tray 5. These members and components include a guide plate 37, a crescent-shaped delivery roller 36, a weight 39 which presses the original sheets P onto the delivery roller 36, a conveyor roller 40 which is driven to rotate in the direction of feed of the original sheet, and a separator belt 41 which runs in the counter direction.

The conveyor roller 40 and the separator belt 41 in cooperation form a separation device of the closed path (TC). The above-mentioned second conveyance passage 45 is disposed downstream of the separating device 40, 41 so that the separated original sheet P is fed along passage 45 to the platen glass 3 which provides the reading position. The second conveyance passage 45 includes a conveyor roller pair 43, a register sensor 48, a pair of register rollers 46 and a pair of conveyor rollers 47.

A guide member 50 disposed between the above-mentioned pair of conveying rollers 47 and the conveyor belt 20 serves to guide the original sheet P to the platen glass 3 and also to guide the original sheet P on the platen glass 3.

Manual insertion of an original sheet P is also possible by using a manual insert sheet tray 51, through operations of a manual-insert sheet feed roller 52 and guide plates 53, 54 for manually inserted sheets.

A description will now be given of the operations of the shutter 6 and the original sheet tray 5 performed when the original sheets P are fed.

Figure 4A:
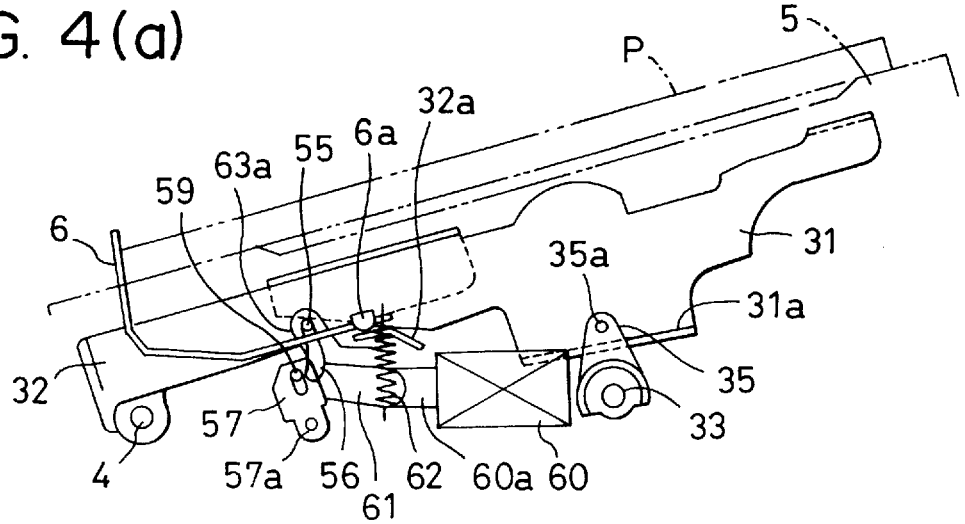
FIG. 4(*a*) is a side elevational view of a shutter device and an original sheet tray of the sheet feeding apparatus of the present invention, in a state in which a sheet is fed through a switch-back passage.
Figure 4B:
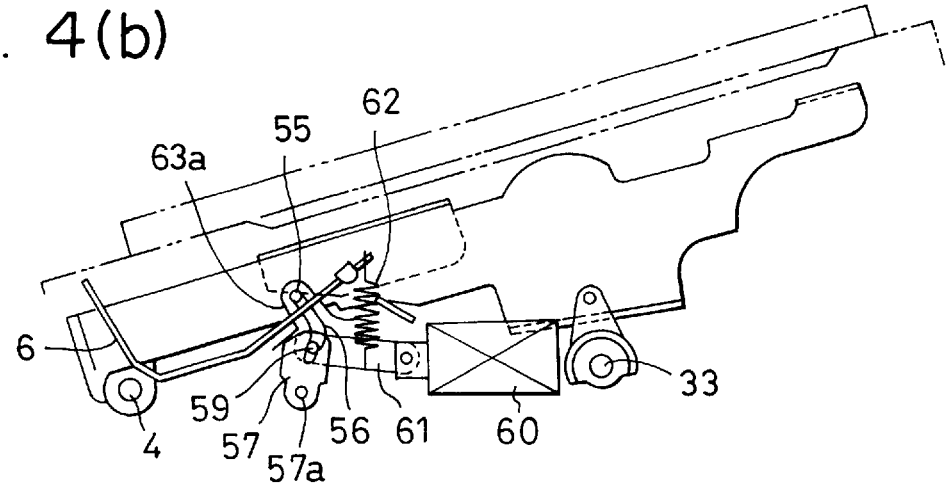
Figure 4C:
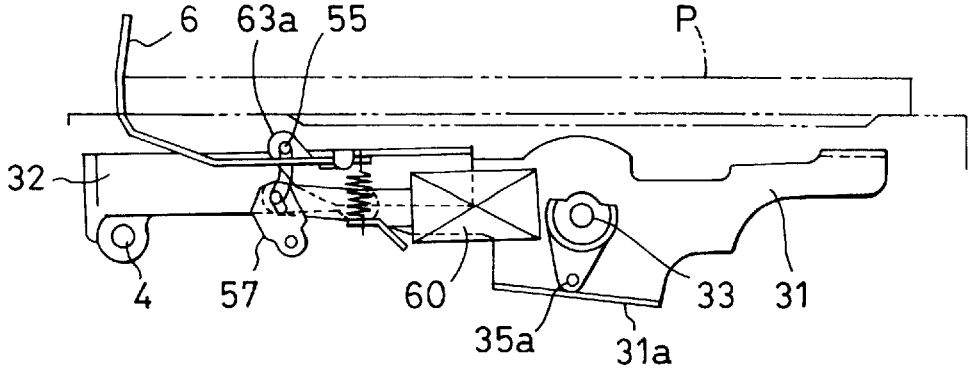
Figure 6:
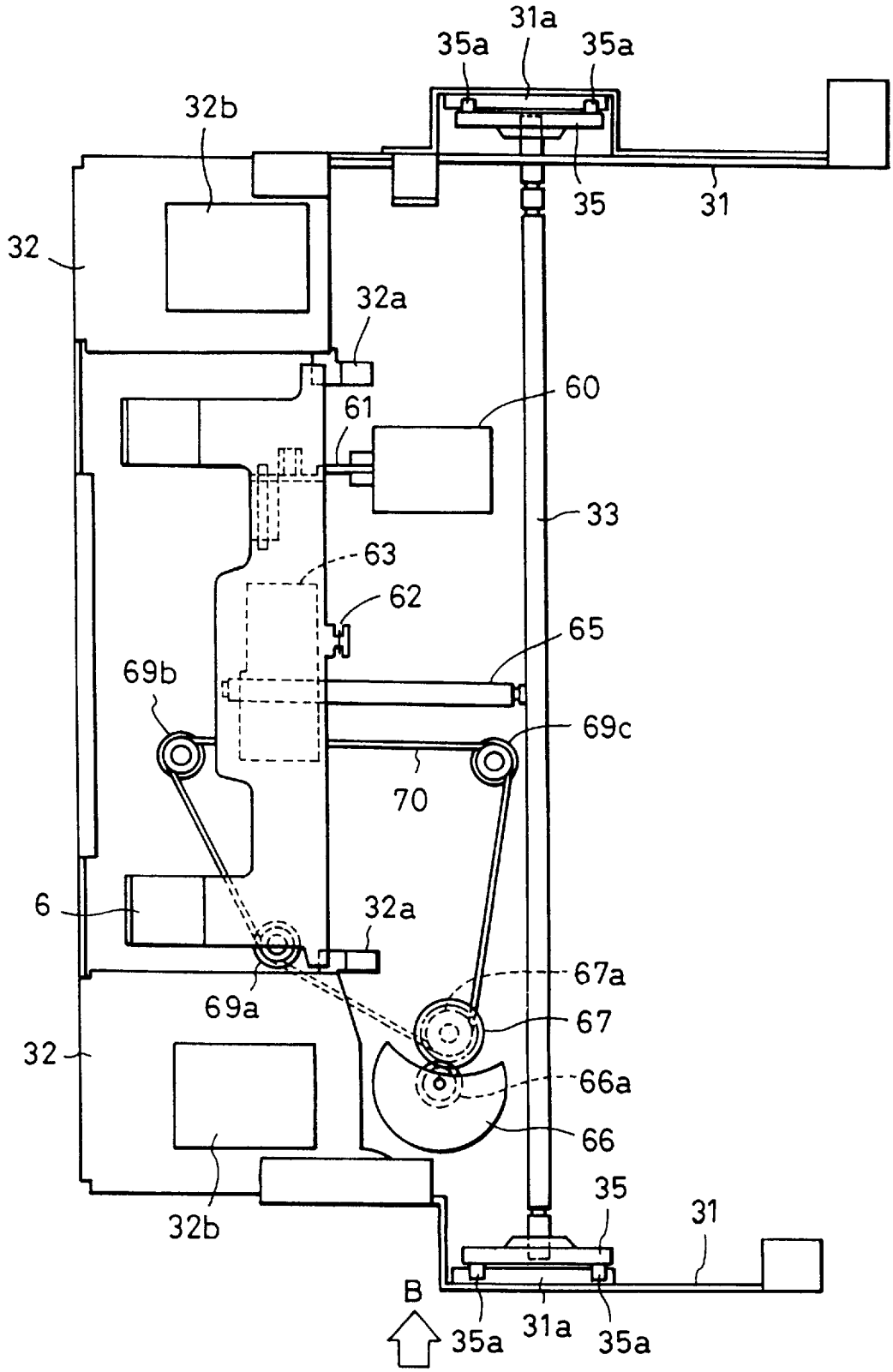
FIG. 6 is a plan view of a shutter device and a shutter unit driving unit used in the present invention.

Referring to FIGS. 4(*a*) to 6, a frame 31 and a supporting member 32 integral therewith are fixed to each side of the original sheet tray 5. The supporting member 32 is pivotable about an axis provided by a pivot shaft 4. Each frame 31 is bent at its lower end portion so as to provide a tab 31*a*. The arrangement is such that the frame 31 is lowered as drive pins 35*a* provided on the free end of a driving member (lifting means) 35 press the tab 31*a* downward. The driving member 35 is fixed to each end of a connecting shaft 33 which is driven to rotate by the operation of an actuator such as a motor (not shown). The driving member 35 and the actuator in combination constitute a tray lifting device which drives the original sheet tray 5 up and down. Referring to FIG. 6, each supporting member 32 has an aperture 32*b* through which the delivery roller 9 emerges when the delivery roller 9 rotates to feed the original sheet.

When the original sheets P are fed with the rear end of the sheet serving as the leading end, for the purpose of glancing to enable high-speed reading, the above-mentioned driving member 35 is rotated so that the drive pins 35*a* press the tabs 31*a* of the frame 31 downward, whereby the original sheet tray 5 is rotated from the inclined position shown in FIG. 4(*a*) to the horizontal position shown in FIG. 4(*c*).

Referring to FIGS. 4(*a*) to 4(*c*), a supporting shaft 55 integral with the shutter 6 is rotatably supported by a supporting portion 63*a* which is integral with a block 63 (see FIG. 6). Reference numeral 60 designates a solenoid for actuating the shutter 6. The solenoid 60 has a plunging member 60*a* to which pivotally connected is one end of a connecting member 61 the other end of which has a pin 59 fixed thereto. This pin 59 engages with an elongated hole formed in the free end of the arm 57 which is pivotable about an axis presented by a support shaft 57*a*.

The pin 59 opposes the lower end of a driven member 56 which is fixed at its free end to the aforementioned supporting shaft 55. A tension spring 62 retained at its both ends by the shutter 6, and the connecting member 61 urges the shutter 6 counterclockwise as viewed in FIGS. 4(*a*) through 4(*c*), i.e., in such a direction that the shutter 6 projects from the original sheet tray 5.

In order to produce a plurality of copies of an original sheet by reading the image of the original in the stationary mode, an original sheet P on the original sheet tray 5 is conveyed along the first conveyance passage 16. In this case, the shutter 6 functions as a shutter, and the amount of projection of the shutter 6 from the original sheet tray 5 is small as shown in FIG. 4(*a*). When a sheet feed start signal is given by the control unit 930 (see FIG. 2) to the solenoid 60, the arm 57 swings clockwise as viewed in FIG. 4(*a*), so that the driven member 56 is pressed by the pin 59 so as to rotate counterclockwise as viewed in FIG. 4(*b*). This causes the shutter 6 integral with the arm 57 to be swung in the same direction as the arm 57, whereby the shutter 6 is retracted from the top face of the original sheet tray 5 (see FIG. 4(*b*)). The delivery roller 9 is driven to rotate in this state, whereby several original sheets are fed into the separation device 11, 12.

Figure 5A:
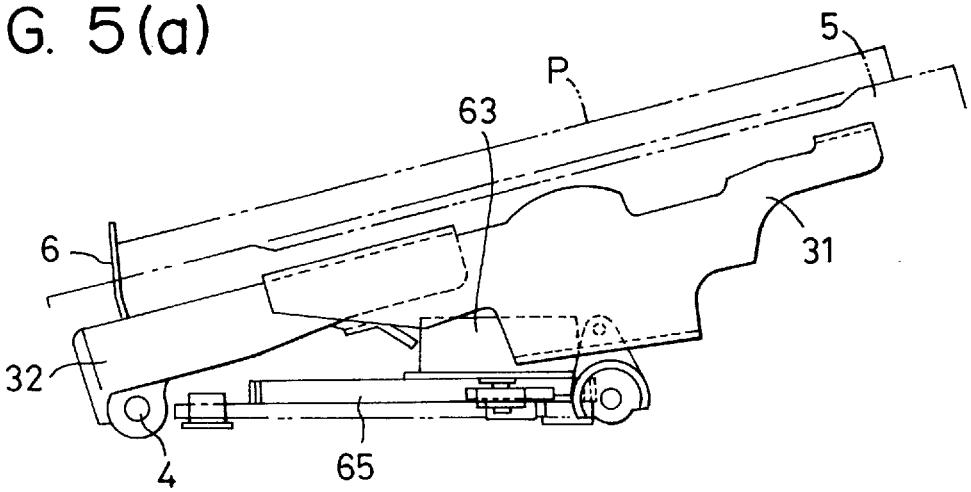
FIG. 5(*a*) is a side elevational view of a shutter device and an original sheet tray of the sheet feeding apparatus of the present invention, in a state in which an original sheet is fed through a switch-back passage.
Figure 5B:
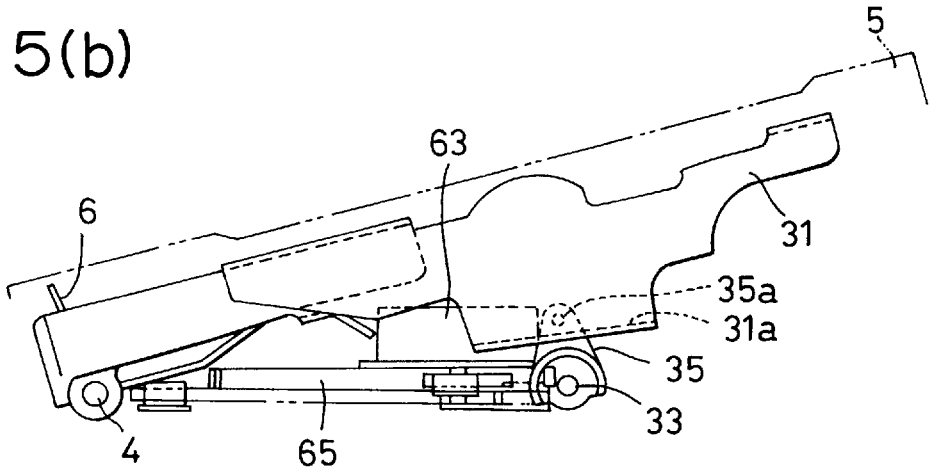
Figure 5C:
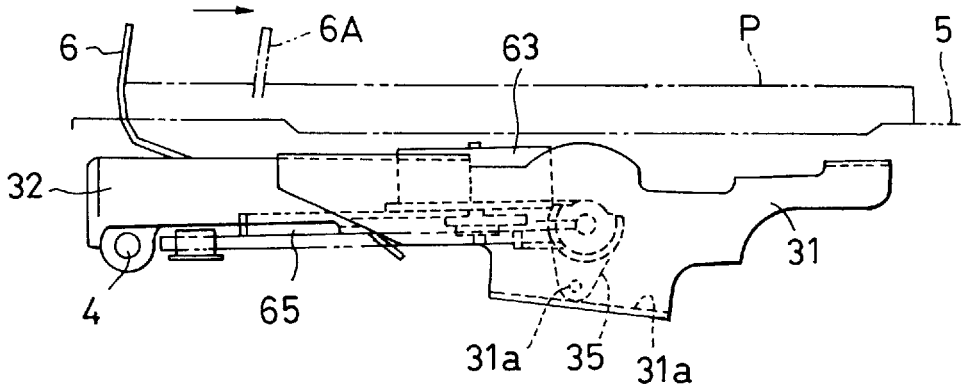

Referring to FIGS. 5(*a*), 5(*b*), 5(*c*) and 6, a block 63 carrying the shutter 6 is movably supported by the guide shaft 65. During movement of the shutter 6 to the illustrated original position, guide members 32*a* engage with projections 6*a* on both sides of the shutter 6 so as to guide the shutter 6. In the state shown in FIG. 4(*a*), the projections 6*a* are held in pressure contact with guide tabs 32*a* by the forces of tension springs 62.

In FIG. 6 reference numeral 66 denotes a pulse motor which serves as a stack conveyance motor adapted to shift the shutter 6 along the top face of the original sheet tray 5. An output gear 66*a* fixed to the output shaft of the pulse motor 66 engages with the pulley gear 67. A belt 70 is wound around a pulley 67*a* of the pulley gear 67 and a plurality of pulleys 69*a*, 69*b* and 69*c*. The belt 70 is connected to the block 63, so that, when the motor 66 steps in accordance with the length of the original sheet P, the shutter 6 moves in the longitudinal direction of the original sheet tray 5, i.e., in the back and forth directions as viewed in the direction of feed of the original sheet.

When it is desired that the original sheet P is fed along the second conveyance passage 45 with the rear end of the sheet serving as the leading end as viewed in the direction of feeding, the original sheet tray 5 is lowered to the horizontal position as shown in FIG. 4(*c*), while the shutter 6 is held in the position as shown in FIG. 4(*a*). As a result, the guide tabs 32*a* of the supporting members 32 integral with the original sheet tray 5 swing downwardly, so that the projections 6*a* of the shutter 6 which have been contacted by the guide tabs 32*a* are rotated in the same direction, i.e., clockwise as viewed in FIGS. 4(*a*) through 4(*c*), accompanying the movement of the guide tabs 32*a*.

As a consequence, the shutter 6 is rotated clockwise relative to the original sheet tray 5, so that the shutter 6 projects by a greater amount as shown in FIG. 4(*c*). In this state, the shutter 6 is driven by the motor 66 towards the second sheet delivery roller 36, whereby the stack of the sheets P is shifted to a position where it is possible to feed the sheets into the second conveyance passage 45 by the operation of the second sheet delivery roller 36 and the second separation device 40, 41.

Thus, the shutter 6 serves also as a stack conveying means. Provided that the shutter 6 is projected by a large amount, the front ends of the original sheets P tacked on the original sheet tray 5 can be engaged by the shutter 6 regardless of any curling of the front ends of these sheets, whereby the stack of the original sheets P is conveyed stably.

The original sheet P fed by the second sheet delivery roller 36 and separated by the separation device 40, 41 is conveyed along the second conveyance passage 45 onto the platen glass 3 which provides the reading position. The original sheet P is then conveyed by the conveyor belt 20 while being quickly read, i.e., glanced, by the light source 907A which is stationed at a predetermined position, and is then discharged onto the original sheet tray 5 through the ejection passage 26.

Referring to FIG. 1, when the original sheet P is glanced, the light source 907A serving as the reading means has been moved to and stationed at a predetermined position. At a region above the stationed light source 907A, both lateral end portions of the conveyor belt 20 are pressed onto the platen glass 3 by means of a pair of pressing members 20. This arrangement prevents both lateral end portions of the original sheet P from floating above the surface of the platen glass 3, despite any waving or undulation of both side portions of the conveyor belt 20, thus preventing reading failure which otherwise may be caused by a floating conveyor belt.

Figure 7A:
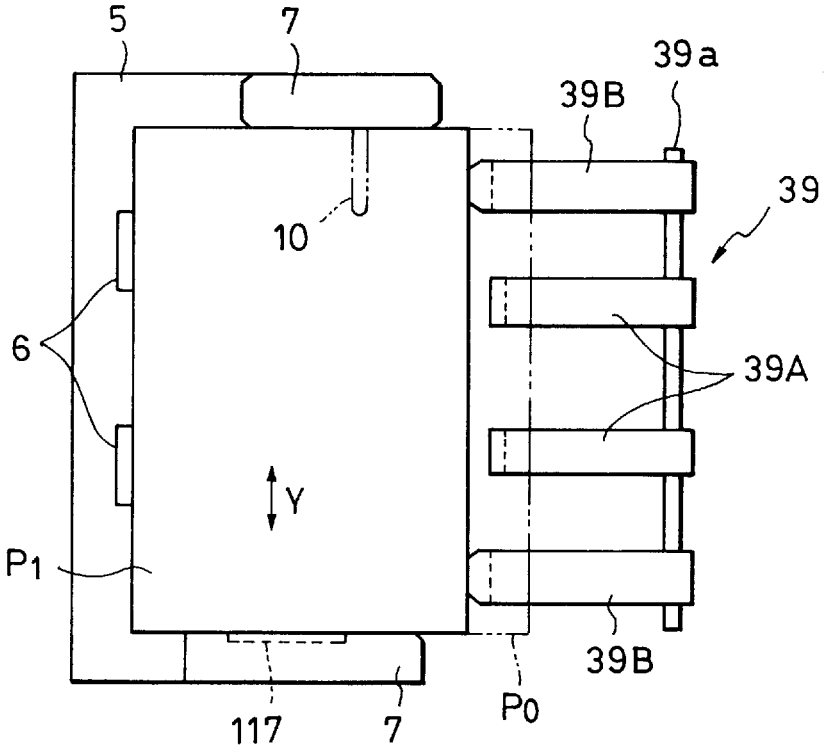
FIG. 7(*a*) is a plan view of an original sheet tray and a weight.
Figure 7B:
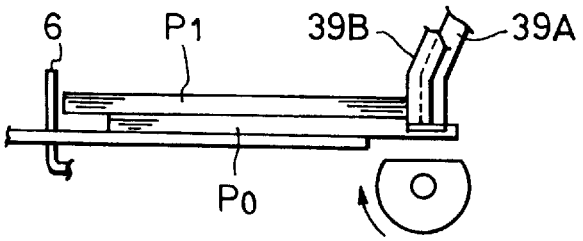

FIGS. 7(*a*) and 7(*b*) show the shutter 6 together with the weight 39 which presses the sheet stack pushed by the shutter 6 and which serves to separate the original sheets which have been fed from the tray 5 and then returned to the tray 5 from the stack of the sheets which have not yet been fed into the apparatus. More specifically, referring to FIG. 7(*a*), a pair of breadthwise regulating plates 7 have been manually operated to regulate the positions of both lateral side edges of the sheets P. More specifically, the original sheets P are registered in the breadthwise directions, i.e., in the direction of the arrow Y, by breadthwise reciprocating motion of a jog member 117 provided on one of the breadthwise regulating plates 7.

The weight 39 includes vertically swingable pressing members 39A which are pivoted at their base ends to a support shaft 39*a* so as to be able to press, against the sheet delivery roller 36, the original sheets $P_0$ on the original sheet tray which have not yet been fed. The weight 39 also includes stopper members 39B which are pivoted at their base ends to the support shaft 39*a* and which serve to stop the leading ends of the sheets $P_1$ fed from and returned to the original sheet tray 5 after one cycle of feeding and then placed on the sheets $P_0$ which have not yet been supplied, as shown in FIG. 7(*b*).

Figure 8:
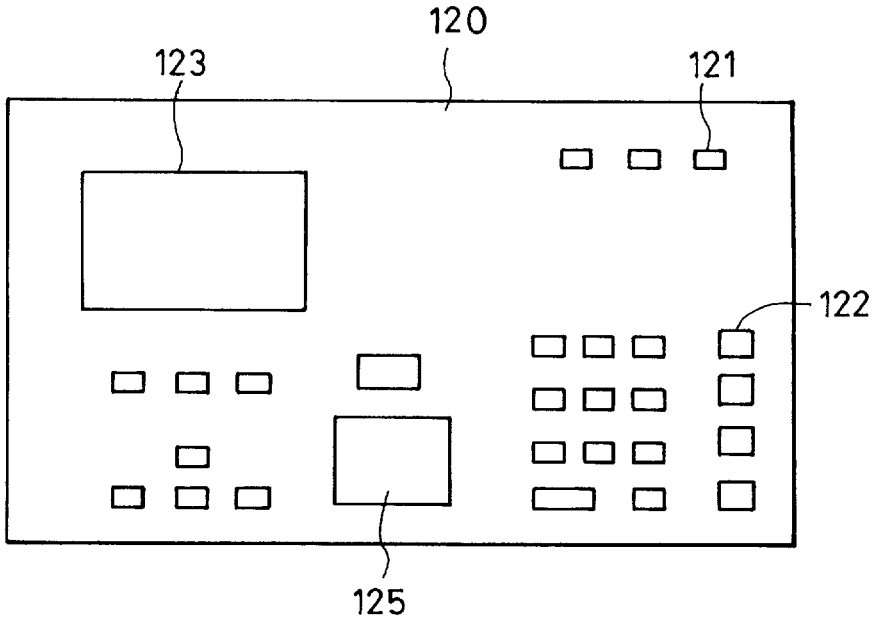
FIG. 8 is a plan view of a control panel used in an apparatus embodying the present invention.

FIG. 8 shows a control panel 120 through which an operator controls the operations of the main part 900 of the copying apparatus and the automatic original sheet feeding apparatus 2. The control panel 120 has a start button 125, a stop key 121 for stopping the feed of the original sheets P and a glancing adjusting key 122.

Figure 9:
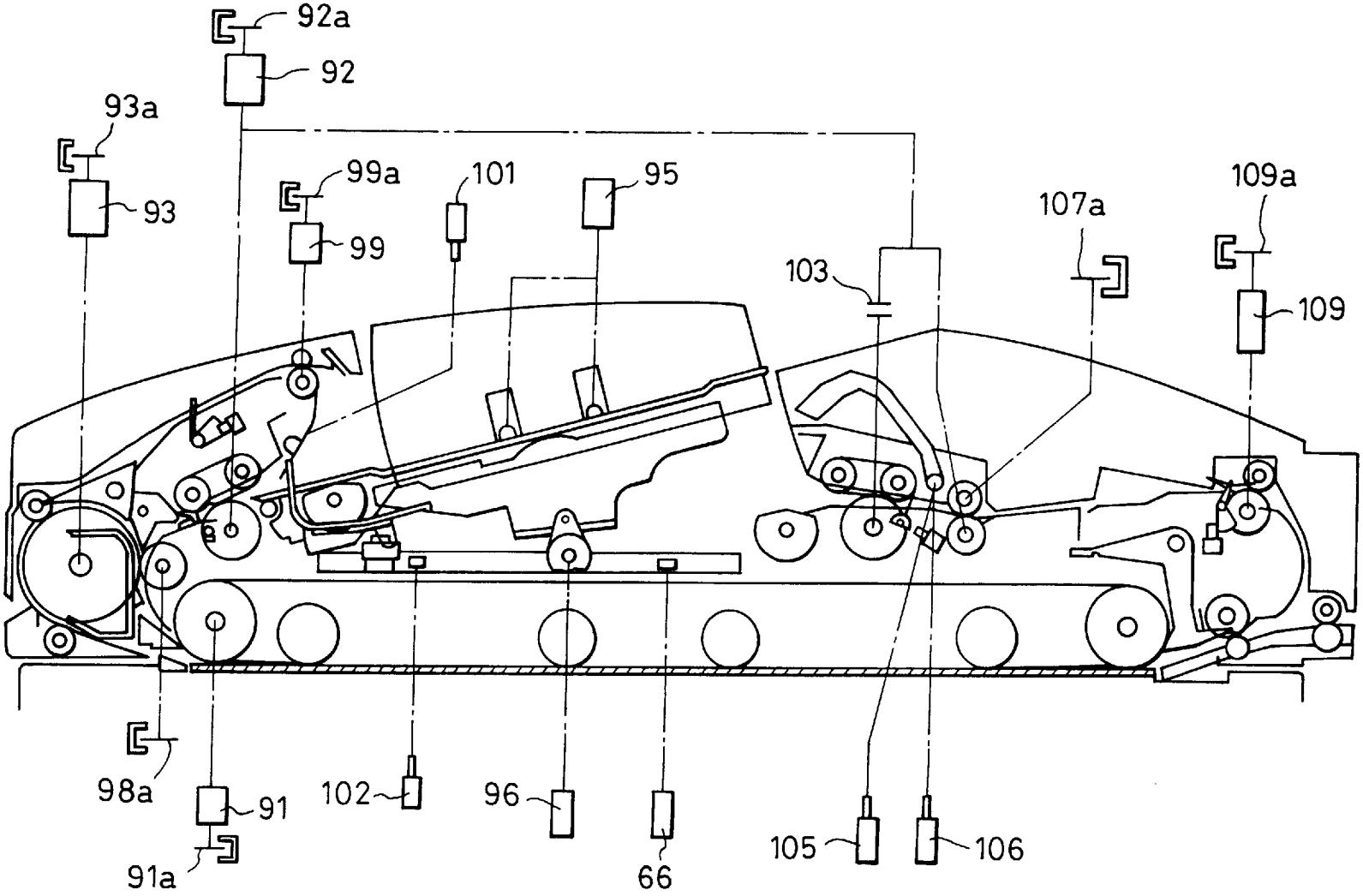
FIG. 9 is a longitudinal sectional view of a driving system for driving an automatic original feeding apparatus in accordance with the present invention.

FIG. 9 illustrates the construction of the driving system for driving the automatic original sheet feeding apparatus.

The driving system includes the following devices and components: a recycle motor 95 for driving the aforesaid recycle lever 10 which separates the sheets P fed and returned to the original sheet tray from the sheets P which have not yet been fed; a weight solenoid 101 which operates to lift and lower the pressing member 8; a shutter solenoid 102 for actuating the shutter 6; a separator motor 92; a separator motor encoder 92*a*; a clutch 103 which selectively transmits the torque of the separator motor 92 to the separation device 40, 41; a belt motor 91 for driving the conveyor belt 20; a belt motor encoder 93*a*; a tray lifting motor 96 for moving the original sheet tray 5 up and down; an idle roller encoder 98*a* associated with the pair of register rollers 13, 15; a sheet ejector motor 99; a sheet ejector motor encoder 99*a* for driving the pair of ejector rollers 29; the aforementioned sheet stack conveyor motor 66 for actuating the shutter 6; a stopper member actuating solenoid 105 for moving the stopper members 39B up and down; a weight solenoid 106 for driving the pressing members 39A up and down; a conveyor roller pair encoder 107*a*; a TC register motor 109 for driving the register roller pair 46; and a TC register motor encoder 109*a*.

Figure 10:
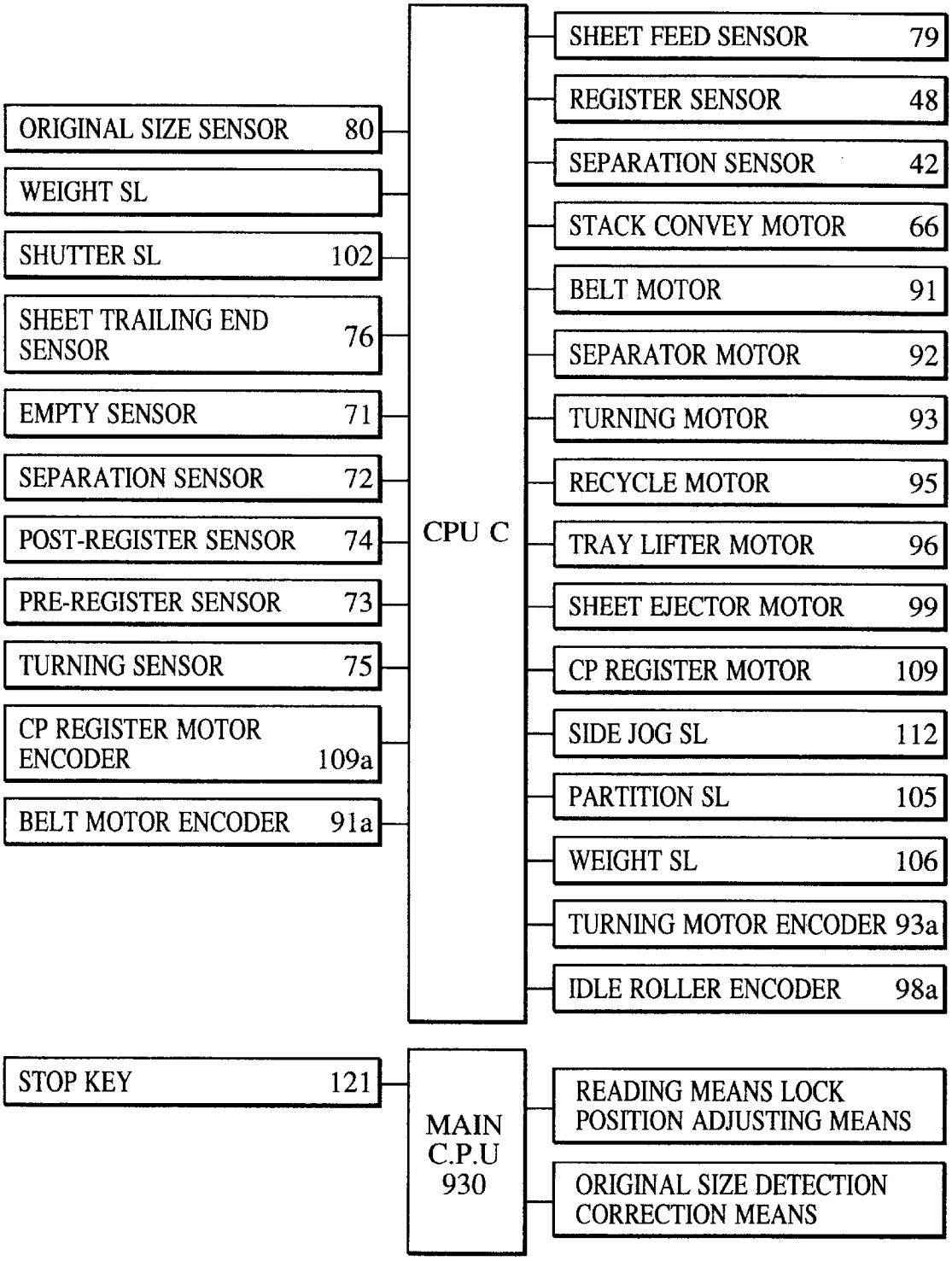
FIG. 10 is a block diagram showing the control of the automatic original sheet feeding apparatus.

FIG. 10 is a block diagram illustrative of the control of the automatic original sheet feeding apparatus 2.

Various sensors arranged at critical portions of the automatic original sheet feeding apparatus shown in FIG. 1 are connected to the control unit 930. These sensors include, referring to FIG. 1, an empty sensor 71 for detecting presence/absence of an original sheet P on the original sheet tray 5, a separation sensor 72, a pre-register sensor 73 for detecting the registered original sheets P, a post-register sensor 74, a turning sensor 75 for sensing the sheet P passing the turning roller 13, a trailing end sheet sensor 76, a TC separation sensor 42, a register sensor 48 and a sheet feed sensor 79.

Figure 11:
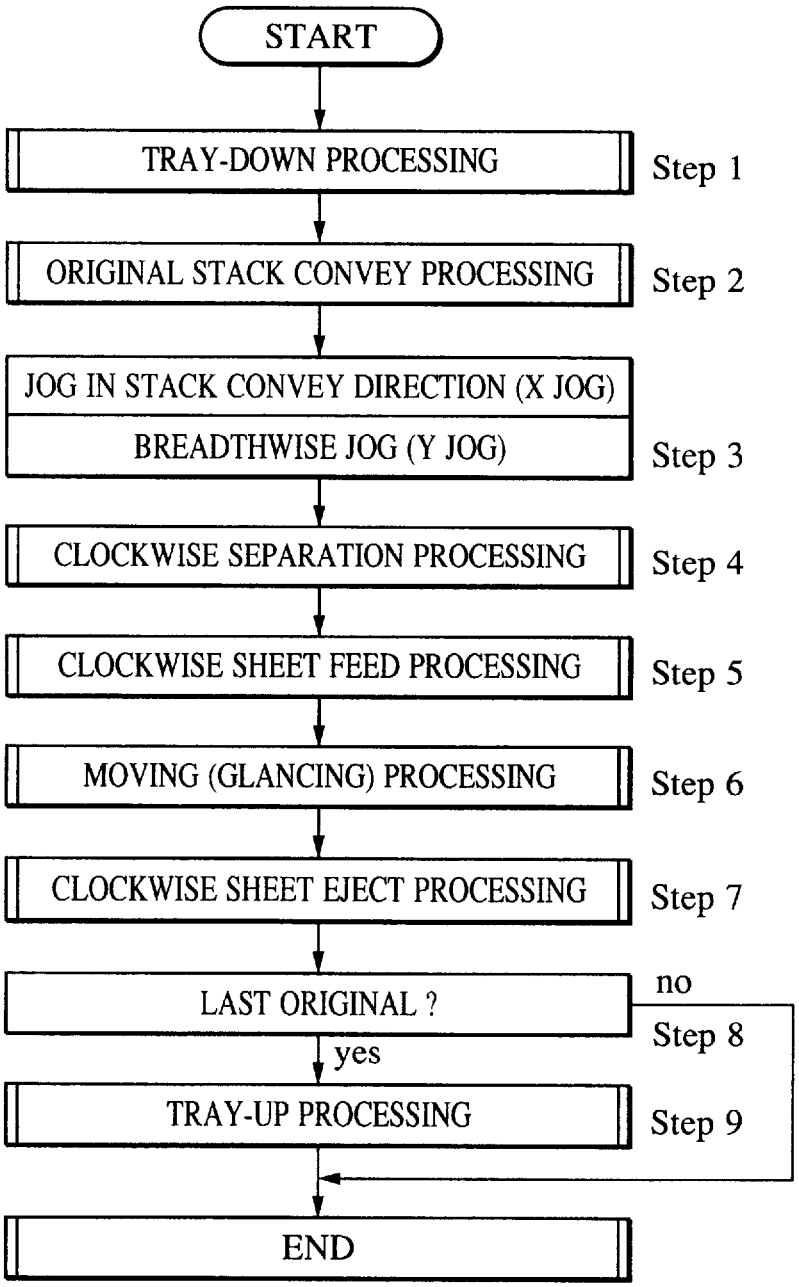
FIG. 11 is a flowchart illustrative of a glancing mode operation of the apparatus in accordance with the present invention.

A description will now be given of the glancing mode for quickly reading the image on the original sheet P, with specific reference to FIG. 11.

Step 1 executes a tray-down processing for moving the original sheet tray 5 to the lowermost position of its stroke, followed by Step 2 in which an original sheet stack conveying operation is executed to shift the original sheet stack P to the right. Then, Step 3 executes an X-jog operation to jog the sheet stack P in the direction of feed, followed by a Y-jog operation which jogs the sheet stack in the breadthwise direction. Then, Step 4 is conducted to separate only the lowermost sheet from the sheet stack.

Then, clockwise sheet feeding processing, step 5, is executed so as to set the original sheet to a position which is upstream of and spaced a predetermined distance from a position where the glancing of the original is to be started. Subsequently, upon receipt of an original exchange (glancing start) trigger from the main part 900 of the apparatus, a glancing processing is executed, step 6, to read the original quickly by moving the original sheet relative to the optical system which is stationed at a predetermined position in the main part 900 of the apparatus, and the original sheet is moved at a predetermined velocity to a position where the reading in stationary mode is to be started. Then, clockwise sheet ejection processing, Step 7, is executed so that the original sheet is ejected onto the original sheet tray 5.

When a negative answer is obtained in the later-mentioned last original sheet discriminating operation in the aforesaid clockwise separation processing, Step 4, the clockwise separation processing is triggered for the next original sheet during execution of the subsequent Step 5 for the clockwise separation, whereby the sheets are fed successively and continuously.

After completion of the clockwise eject processing, Step 8, a question is posed as to whether the original sheet is the last one. If the answer is YES, i.e., if the original sheet which has just been processed in Step 7 is the last sheet, the process advances to Step 9 which executes tray-up processing, whereby the original sheet tray 5 is reset to the initial position.

When a plurality of image forming cycles are to be executed after completion of the glancing processing, Step 6, the main part 900 of the apparatus operates to return the light source 907 to the home position adjacent to the position where the reading in the stationary mode is to be started, and the light source 907 is made to reciprocate the desired number of times, thus reading the original image in the stationary mode.

Figure 12:
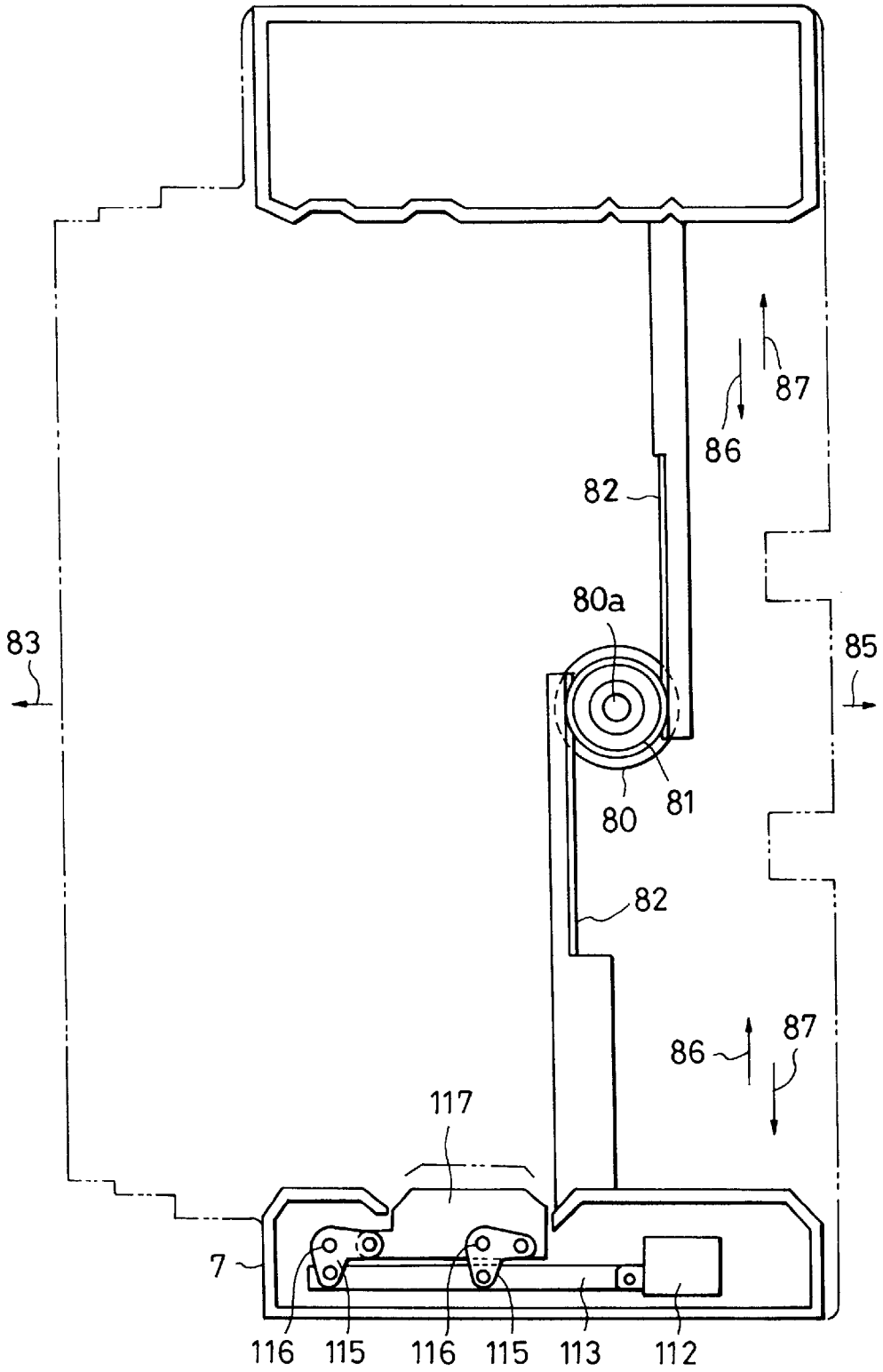
FIG. 12 is an illustration of a breadthwise regulating plate and a driver for the same, used in an apparatus of the present invention.

A description will now be given of the driving mechanism for the breadthwise regulating plates 7 with reference to FIG. 12.

The pair of breadthwise regulating plates 7 are disposed on both lateral sides of the original sheet tray 5 for movement in the breadthwise directions indicated by arrows 86, 87. An original size sensor (original size sensing means) 80, which includes a rotary member, is disposed at the center of the original sheet tray 5. The rotary member 80 has an output shaft 80*a* to which is fixed a pinion 81. A pair of racks 82 engage with the pinion 81 at opposite sides thereof. These racks 82 are fixed at their base ends to the breadthwise regulating plates 7. As the operator manually moves the breadthwise regulating plates 7 such that they contact both lateral ends of the stack of the sheets P, the rotor of the rotary member 80 is rotated in accordance with the breadth of the original sheet P, whereby the size of the original sheet P is automatically detected.

Figure 13:
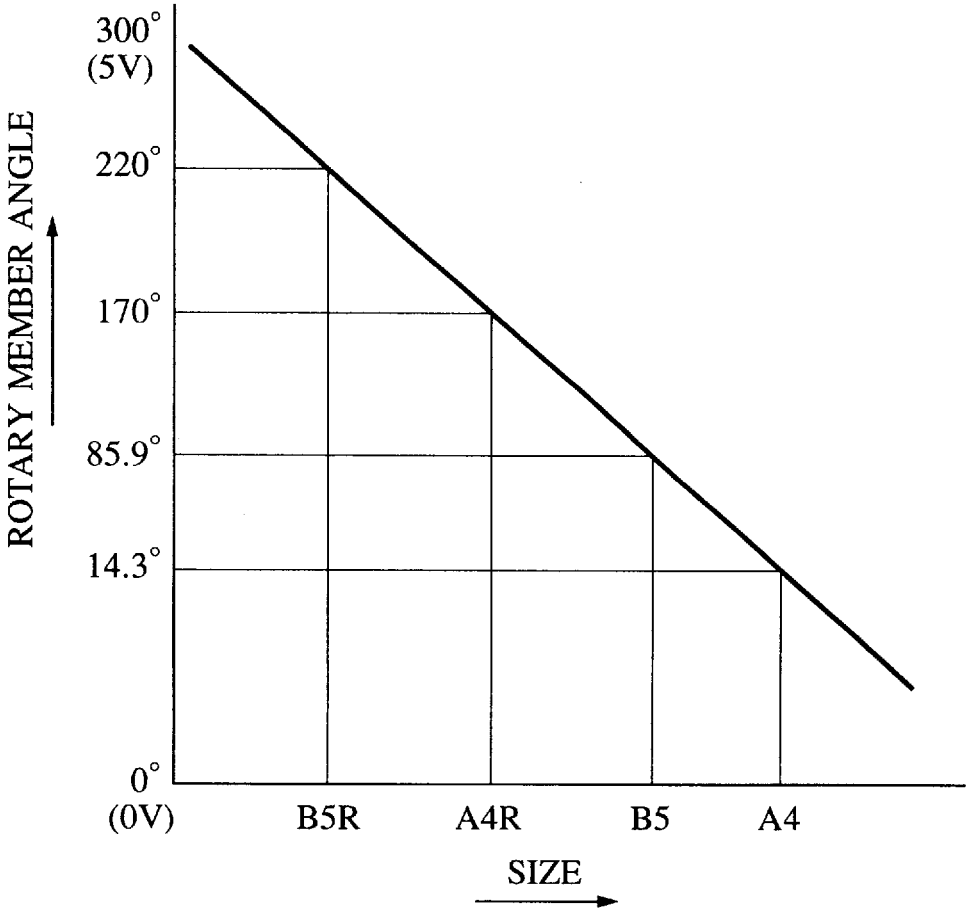
FIG. 13 is a graph illustrative of the correlation between the original size and the rotary member angle.

FIG. 13 illustrates the relationship between the size of the sheets P stacked on the original sheet tray 5 and the angular displacement of the rotor of the rotary member 80. It will be understood that the size of the original sheets P stacked in the original sheet tray 5 can be known from the amount of angular displacement of the rotor of the rotary member 80.

One of the breadthwise regulating plates 7 incorporates a side jog (Y-jog) solenoid 112 having a plunger to which is connected an elongated bar 113. Each of a pair of links 115 is pivotally connected at its one end to the elongated bar 113 while the other end of the link 115 is pivotally connected to the jog member 117. According to this arrangement, repeated turning on and off of the side jog solenoid 112 causes the jog member 117 to reciprocately move in the breadthwise direction of the original sheet tray 5, whereby the original sheets P stacked on the tray are registered in the breadthwise direction.

A detailed description will now be given with specific reference to FIGS. 14(*a*) and 14(*b*) as to the separation device 11, 12 which separates the sheets one by one from the stack on the original sheet tray 5.

Figure 14A:
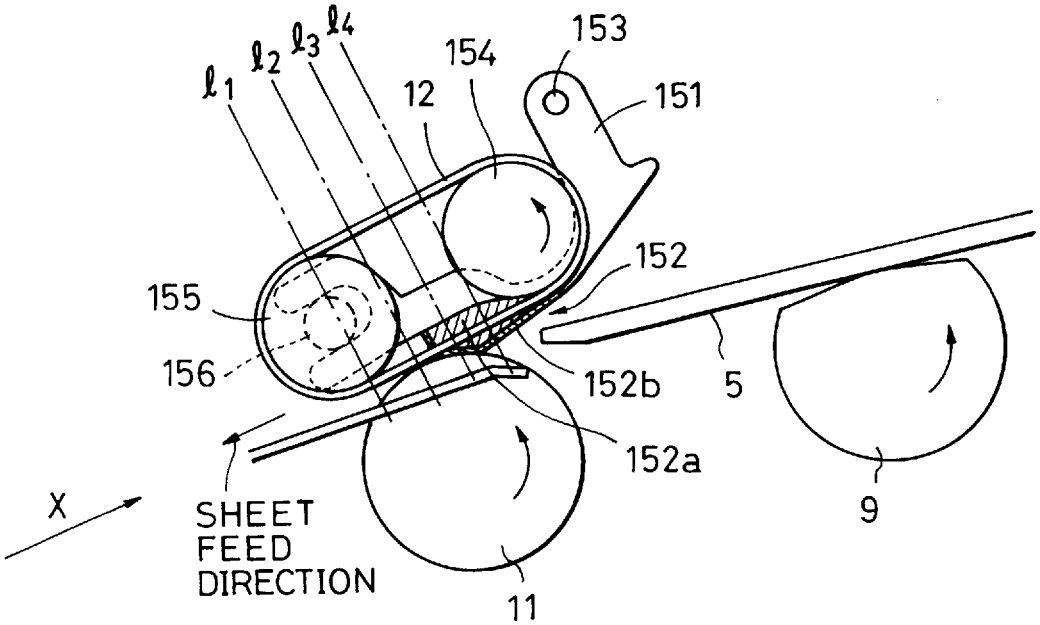
FIG. 14(*a*) is a longitudinal sectional view of a separation device provided for a switch-back passage in a first embodiment of the present invention.
Figure 14B:
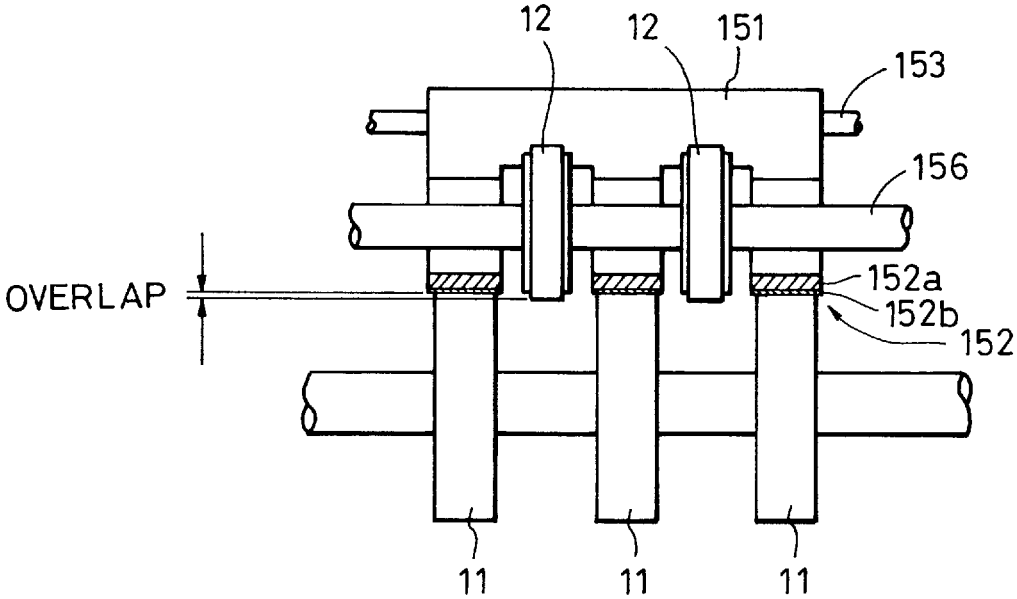

FIGS. 14(*a*) is a side elevational view of the separation device 11, 12, while FIG. 14(*b*) is a view as viewed in the direction of the arrow X. There are shown a crescent-shaped delivery roller 9 which rotates counterclockwise and a sheet feed roller 11. The separation device further includes separator belts 12 each being wound around and stretched between a separator drive pulley 154 and a separator driven pulley 155 and arranged alternatingly with the feed roller 11 in partial overlapping relation therewith. The separator drive pulley 154 is powered to rotate counterclockwise as viewed in FIG. 14(*a*), so that the separator belts 12 run in the direction counter to the direction of feed of the sheets. A separator guide 151 is swingable about a pivot 153. The downstream end of the separator guide 151 as viewed in the direction of feed of the sheets engages with a shaft 156 of the separator driven roller 155. A separator pad 152 hatched in FIGS. 14(*a*) and 14(*b*) is fixed to the separator guide 151 so as to be immediately upstream of the nip formed between the feed roller 11 and the separator belts 12. The separator pad 152 has a base member 152*a* made of a sponge (rubber foam) and a rubber layer 152*b* provided on the outer surface of the base member for contact with the feed roller 11. The separator pad 152 makes resilient contact with the feed roller 11 due to elastic deformation of the sponge constituting the base member 152*a*. A tape of a fluororesin, having a friction coefficient $\mu$ smaller than that $\mu$ of the rubber layer surface, is bonded to a portion of the separator pad 152 upstream of the resilient contact region, in order to facilitate the introduction of the sheet into the nip between the feed roller 11 and the separator belt 12. The portion where the tape of the fluororesin is bonded is upstream of a point $\lambda_4$ shown in FIG. 14(*a*). Films of resins other than the fluororesin, as well as a filler film, may equally be used in place of the above-mentioned tape, provided that such tapes exhibit small values of friction coefficient $\mu$. Regarding the position where the separator pad 152 is pressed against the feed roller 11, it is not essential that the nip between the separator pad 152 and the feed roller 11 is separate and upstream from the nip between the feed roller 11 and the separator belt 12. Specifically, these nips may partially overlap each other.

The feed roller 11 has a friction coefficient greater than those of the separator belt 12 and the rubber layer 152*b* of the separator pad 152, so that only the lowermost sheet of the stack is fed while the remainder sheets of the stack are retained by the separator belt 12 or the separator pad 152.

The above-mentioned sponge is preferably a foamed urethane sponge which has a comparatively uniform distribution of cells, so that it can bear compression load with uniform stress distribution and reduced residual strain.

The rubber layer 152*b* is formed of a urethane rubber which is less liable to be contaminated by ink, toner, pencil lead, or the like carried by the separated sheet. A thin sheet of this foamed urethane resin is bonded or welded to the base member 152*a* formed from the sponge, thus forming the separator pad 152. The separator pad 152 also may be formed by applying a urethane rubber in a liquid phase to the base member 152*a*. When the sheet to be separated has silicone oil or the like deposited thereon, the rubber layer 152*b* of the separator pad 152 may be formed of a silicone rubber which has good compatibility with silicone oil.

Although urethane rubber and silicone rubber have been mentioned as being suitable materials for the surface layer of the separator pad, it is to be understood that these rubber materials are not exclusive and other suitable rubbers can be used for the same purpose provided that they have a friction coefficient $\mu$ exceeding a certain level necessary for retaining the sheets and exhibit superior durability and small tendency of contamination by ink. It is also possible to use materials other than rubber, on the condition that such materials provide an equivalent effect in retaining the sheets, such as, for example, suede felt.

Figure 15:
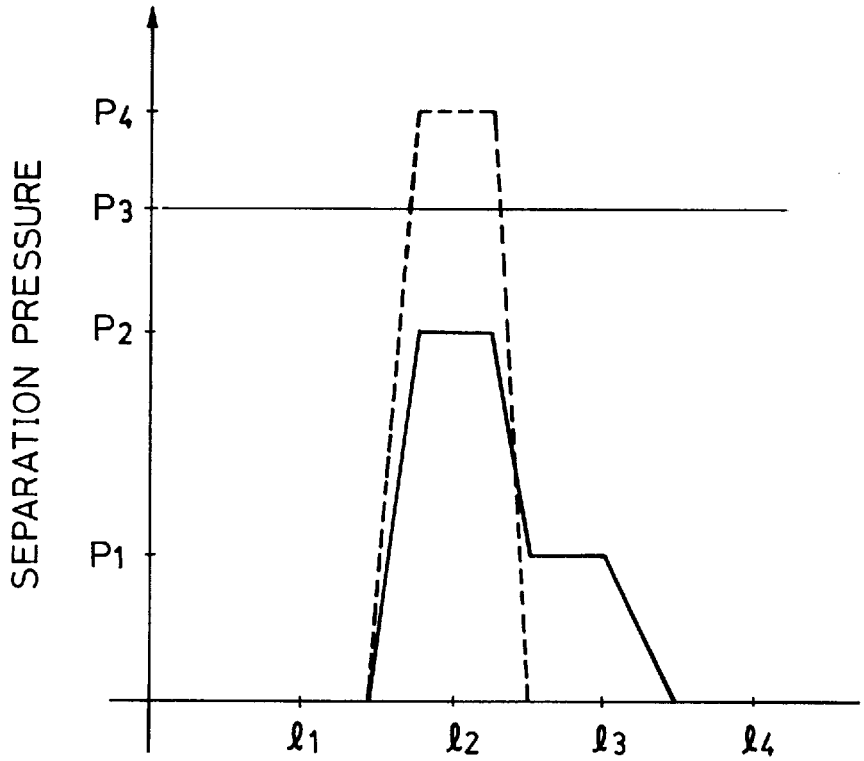
FIG. 15 is a graph showing distribution of separation pressure at the separation nip region in an apparatus embodying the present invention.

FIG. 15 is a diagram showing the levels of separation pressure developed at nip positions $\lambda_1$ to $\lambda_4$ shown in FIG. 14(*a*). The axis of the abscissa shows the nip positions, while the axis of the ordinate shows the level of the separation pressure.

The solid-line curve in FIG. 15 shows the distribution of the separating pressure along the path of movement of the sheet towards the downstream end. Separation pressure $P_1$ exerted by the separator pad 152 starts to be built up at a point between the positions $\lambda_4$ and $\lambda_3$. The level of this pressure $P_1$ is not so high because this pressure is derived from the elastic deformation of the sponge. Then, separation pressure due to the separator belt 12 starts to be built up at a position intermediate between the positions $\lambda_3$ and $\lambda_2$, and is maximized to a level $P_2$ in the region around the position $\lambda_2$. The separation pressure then decreases gradually.

Meanwhile, the broken-line curve in FIG. 15 shows the distribution of separating pressure as observed in conventional device devoid of a member which would correspond to the separator pad 152 used in the present invention. It will be seen that, in the conventional separation device, a high peak of separation pressure $P_4$ is created locally in order that the separator belts alone can develop required separation performance for a wide variety of sheet materials.

As described before, when sheets to be separated are copies or prints produced by a copying apparatus or a printer and, hence, carry images formed of a toner or ink fixed thereto, the toner or the ink on the lowermost sheet tends to be transferred to the reverse side of the second sheet when these two sheets are pressed at the nip of the separation device, thus causing the contamination known as setoff. The contamination becomes more noticeable when the pressure increases. The separation pressure $P_3$ is a threshold pressure at which setoff starts to appear.

It will be seen that this threshold pressure $P_3$ is exceeded by the separation pressure in the conventional device shown by the broken-line curve. In contrast, in the embodiment of the present invention, even the highest level $P_2$ of the separation pressure is still below the above-mentioned threshold pressure $P_3$, so that the problem of setoff does not occur. The reduction of the maximum separation pressure to $P_2$ is compensated for by the pressure $P_1$ exerted by the separator pad 152, so that the whole separation device produces separation effect equivalent to that of the conventional device, adapting to a variety of sheet materials.

Even when the sheets in the form of a stack are introduced into the separation nip, the separator pad 152 serves to stagger these sheets such that the leading end of the stack is wedged, thus ensuring that the sheets are separated one-by-one by the nip formed by the separator belts 12, whereby the problem of setoff is eliminated.

Figure 16:
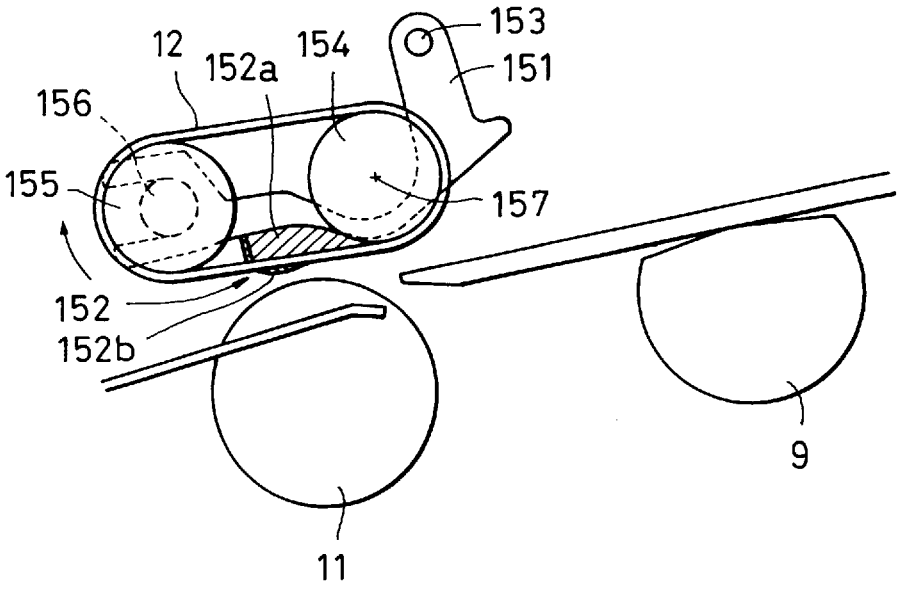
FIG. 16 is a longitudinal sectional view of a separation device for a switch-back passage in an apparatus embodying the present invention.

FIG. 16 illustrates the separation device in a state in which the separation pressure has been relieved.

A holder (not shown) maintains a predetermined distance between the axis 157 of rotation of the separator drive pulley 154 and the axis 156 of the separator driven pulley 155. The holder is swingable about the axis 157 and is urged by, for example, a spring such that the separator driven pulley 155 is lifted upward as indicated by an arrow, thus opening the nip which has been formed between the separator belts 12 and the feed roller 11. The separator guide 151, which engages with the separator idle shaft 156, also is swung about the axis 153, so that the separator pad 152 is moved away from the feed roller 11, thus relieving the pressure.

In the event that the operation of the apparatus has been stopped due to presence of the sheets in the separation device or other troubles such as sheet jam, the separation nip is opened to relieve the pressure, thus facilitating recovery by removal of the sheets.

Figure 17:
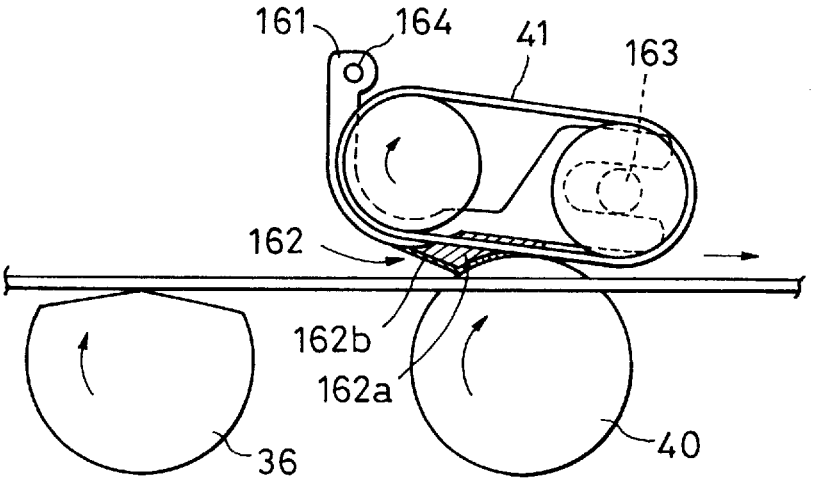
FIG. 17 is a longitudinal sectional view of a separation device for a closed passage in an apparatus embodying the present invention.

FIG. 17 shows the separation device 40, 41 of the closed path TC which is constituted by the second conveyance passage 45, conveyor belt 20 and the ejection passage 26.

The separation device of the closed path TC includes, as in the case of the separation device of the switch-back passage TS, a crescent-shaped delivery roller 36 rotatable clockwise, and sheet feed rollers 40. The separation device further includes separator belts 41 arranged alternately with the feed rollers 40 in a partial overlapping relation therewith, and a separator guide 161, the separator belts 41 and the separator guide 161 being swingable about a pivot point 164, the downstream end of the separator guide 161 engaging with the shaft 163 of the separator driven pulley. A separator pad 162 (hatched in FIG. 17) is fixed to the separator guide 161 at a position upstream of the nip formed between the separator belt 41 and the feed roller 40. The separator pad has a base member 162 made of sponge and a rubber layer 162*b* formed on the base member 162*a* and contactable with the feed roller 40, so that the rubber layer 162*b* makes resilient contact with the feed roller 142 due to elastic deformation of the sponge constituting the base member 162*a*.

As in the case of the separation device for the switchback path described before, the maximum separation pressure developed between the separator belt 41 and the separator pad 162 is lower than the aforesaid threshold pressure $P_3$ at which the setoff phenomenon takes place. Despite the reduced separation pressure, the whole separation device provided separation effect equivalent to that exhibited by conventional separation device, and adapts well to a wide variety of sheet materials, thereby eliminating the problem of setoff.

The present invention can also be realized by using retarding separation device which is known and will be understood from the following description of a second embodiment.

Figure 18:
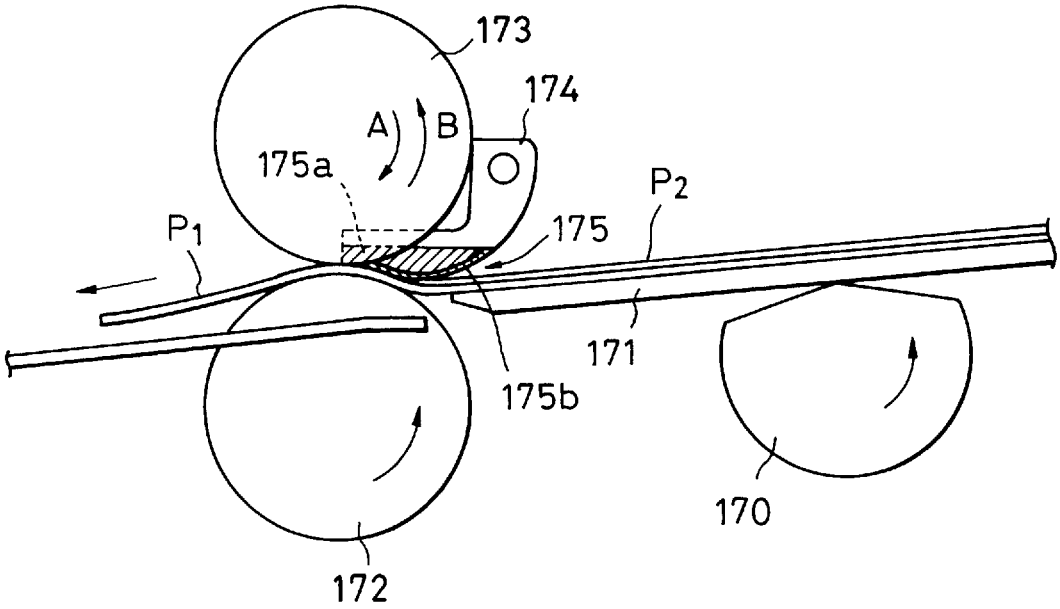
FIG. 18 is a longitudinal sectional view of a separation device used in a second embodiment of the present invention.

Referring to FIG. 18, a crescent-shaped delivery roller 170 and a sheet feed roller 172 rotate as indicated by arrows, so as to deliver and feed sheets from a stack on a tray 171.

A return roller 173 is rotationally urged in the direction of the arrow B by a suitable driving means incorporating a torque limiter. In operation, however, this roller 173 rotates in the direction of the arrow A due to friction with the sheet which is being fed by the feed roller 172, since the torque limiter permits such rotation. However, when two or more sheets have been introduced into the nip between the sheet feed roller 172 and the return roller 173, the return roller 173 rotates in the direction of the arrow B so as to prevent simultaneous feeding of multiple sheets.

The separation device also has a separator guide 174 and a separator pad 175 (hatched in FIG. 18) fixed to the downstream end of the separator guide 174. The separator pad 175 has a base member 175*a* made of a sponge and a surface rubber layer 175*b* contactable with the sheet feed roller 172 or a sheet. The rubber layer 175*b* is adapted to be resiliently pressed onto the portion of the sheet feed roller 172 just upstream of the nip formed between the sheet fed roller 172 and the return roller 173, by elastic deformation of the base member 175 made of sponge. In FIG. 18, the lowermost sheet $P_1$ is being fed, whereas the second sheet $P_2$ is retained by the separator pad 175.

When a multiplicity of sheets are fed or when each sheet has a considerably large thickness, the separator pad 175 alone may fail to retain these sheets. However, the return roller 173 effectively serves so as to separate the lowermost sheet.

In this embodiment also, the pressure developed by the separator pad 175 due to elastic deformation of the sponge of the base member 175*a* and the pressure exerted by the return roller 173 are so small as not to exceed the aforementioned threshold pressure $P_3$ at which the setoff phenomenon starts to appear, so that contamination of the overlying sheets can be avoided.

The present invention also can be carried out by using a dupro-type separation device which also is known and will be understood from the following description of the third embodiment.

Figure 19:
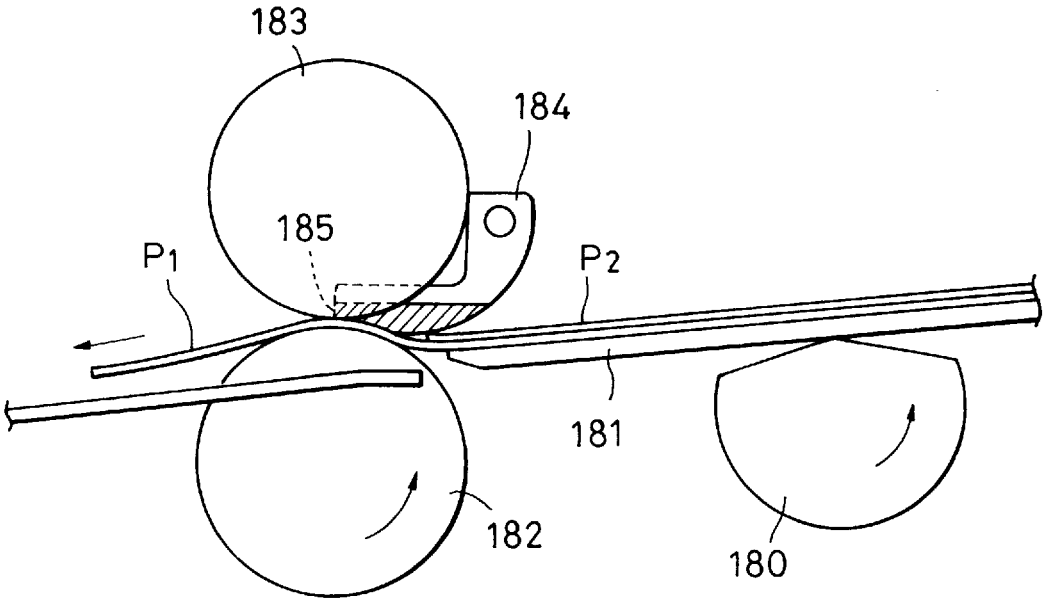
FIG. 19 is a longitudinal sectional view of a separation device used in a third embodiment of the present invention.
Figure 20:
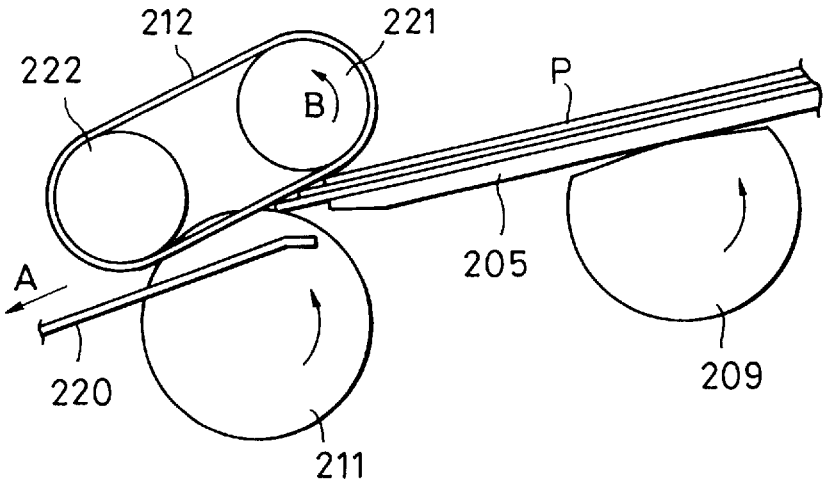
FIG. 20 is a longitudinal sectional view of a known separation device.
Figure 21:
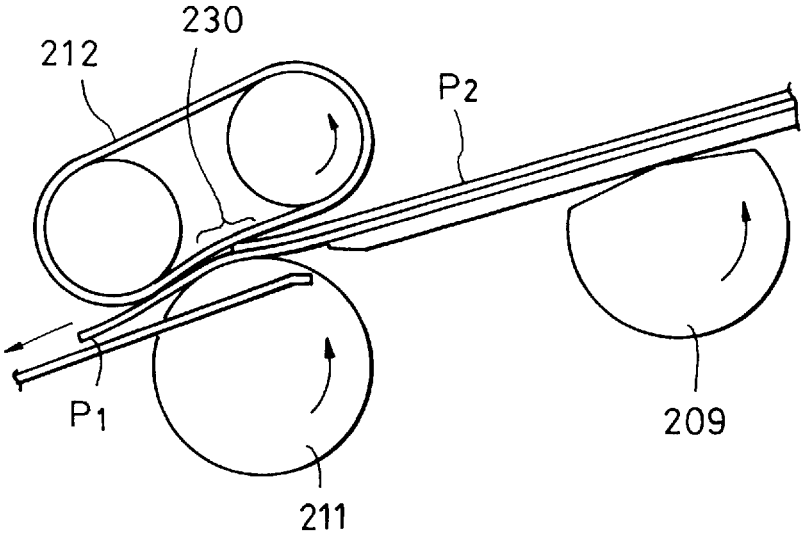
FIG. 21 is a longitudinal sectional view of the known separation device in a state in which a sheet is being fed from a sheet stack.

Referring to FIG. 19, a crescent-shaped delivery roller 180 and a sheet feed roller 182 rotate as indicated by arrows, so as to deliver and feed sheets from a stack on a tray 181. A return roller 182 is pressed to the sheet feed roller 182 but is not driven during separating but serves to prevent simultaneous feed of two or more sheets. In order to avoid local wear of the return roller which may occur at the portion held in pressure contact, the return roller 183 is rotated by a small angle at a suitable interval during suspension of the feeding operation, such that the entire periphery of the roller 183 can effectively be used.

The separation device further has a separator guide 184 and a separator pad 185 (hatched in FIG. 18) fixed to the downstream end of the separator guide 184. The separator pad 185 has a base member made of a sponge and a surface rubber layer contactable with the sheet feed roller 182 or a sheet. The rubber layer is adapted to be resiliently pressed onto the portion of the sheet feed roller 182 just upstream of the nip formed between the sheet fed roller 182 and the return roller 183, by elastic deformation of the base member made of sponge.

In this embodiment also, the pressure developed by the separator pad 185 due to elastic deformation of the sponge of the base member and the pressure exerted by the return roller 183 are so small as not to exceed the aforementioned threshold pressure $P_3$ at which the setoff phenomenon starts to appear, so that sheets can be separated one-by-one without fail and without being accompanied by contamination of the sheets. Thus, the third embodiment as described offers the same advantages as those produced by the first embodiment.

Although the invention has been described together with the separation devices of the types which separate the sheets from the lower end of the sheet stack, the invention can also be realized by using a known sheet separation device of the type which separates the sheet from the top of the stack.

What is claimed is:

1. A sheet feeding apparatus, comprising:

sheet supporting means for supporting sheets;

sheet delivery means for delivering the sheets from said sheet supporting means;

separation means including a rotational feeding member rotatable in a direction of sheet feeding and a counter-rotational member rotatable in a direction counter to the sheet feeding direction, said separation means separating said sheets delivered by said sheet delivery means; and an elastic member disposed in resilient contact with said rotational feeding member at a position upstream of a nip formed between said rotational feeding member and said counter-rotational member, so as to perform sheet separation in cooperation with said rotational feeding member.

2. A sheet feeding apparatus according to claim 1, wherein said elastic member staggers leading ends of said sheets delivered by said delivery means, whereby the staggered sheets are separated one-by-one by the nip between said rotational feeding member and said counter-rotational member.

3. A sheet feeding apparatus according to claim 1, further comprising guiding means for guiding the sheets delivered by said sheet delivery means to the nip between said rotational feeding member and said counter-rotational member, said elastic member being fixed to said guiding means.

4. A sheet feeding apparatus according to claim 1, wherein a plurality of said rotational feeding members and a plurality of said counter-rotational members are arranged alternately in a breadthwise direction of the sheets.

5. A sheet feeding apparatus according to claim 4, wherein said counter-rotational member comprises a separator belt wound around and stretched between a drive pulley and a driven pulley, said separator belt rotating in the direction counter to the sheet feeding direction so as to separate the sheets one-by-one in cooperation with said rotational feeding member.

6. A sheet feeding apparatus according to claim 1, wherein said rotational feeding member and said counter-rotational member are arranged in pressure contact with each other.

7. A sheet feeding apparatus according to claim 1, wherein said elastic member comprises a base member made of a foamed material and a rubber surface layer provided on said base member.

8. A sheet feeding apparatus according to claim 7, wherein said foamed material of said base member comprises a urethane foam and said surface rubber layer comprises a urethane rubber.

9. A sheet feeding apparatus according to claim 7, further comprising a low-friction member disposed at an upstream portion of said rubber surface layer of said elastic member as viewed in the sheet feeding direction, said low-friction member having a low friction coefficient so as to facilitate introduction of the sheets into the nip between said elastic member and said rotational feeding member.

10. A sheet feeding apparatus according to claim 1, wherein said sheet delivery means is disposed under said sheet supporting means and said counter-rotational member of said separation means is disposed on the upper side of said rotational feeding member, so that the sheets are separated and fed one-by-one starting from a lowermost sheet of the sheets supported by said sheet supporting means.

11. A sheet feeding apparatus, comprising:

sheet supporting means for supporting sheets;

sheet delivery means for delivering the sheets from said sheet supporting means;

first separation means including a rotational feeding member rotatable in a direction of sheet feeding and a counter-rotational member-rotatable in a direction counter to the sheet feeding direction; and second separation means disposed in resilient contact with said rotational feeding member at a position upstream of a nip formed between said rotational feeding member and said counter-rotational member, so as to perform sheet separation in cooperation with said rotational feeding member;

wherein a level of first separating pressure exerted by said first separation means and a level of second separating pressure exerted by said second separation means are below a predetermined level of a separating pressure.

12. A sheet feeding apparatus according to claim 11, wherein the separating pressure exerted by said first separation means and the separating pressure exerted by said second separation means are continuously applied to said sheet.

13. A sheet feeding apparatus according to claim 12, wherein said second separation means is disposed upstream of said first separation means as viewed in the sheet feeding direction.

14. A sheet feeding apparatus according to claim 11, wherein said first separation means and said second separation means are arranged adjacent to each other in the sheet feeding direction.

15. A sheet feeding apparatus according to claim 14, wherein said second separation means is disposed upstream of said first separation means as viewed in the sheet feeding direction.

16. A sheet feeding apparatus according to claim 11, wherein the level of the separating pressure exerted by said first separation means is higher than that of the separating pressure exerted by said second separation means.

17. A sheet feeding apparatus according to claim 11, wherein a plurality of said rotational feeding members and a plurality of said counter-rotational members are arranged alternately in a breadthwise direction of the sheets.

18. A sheet feeding apparatus according to claim 11, wherein said rotational feeding member and said counter-rotational member are arranged in pressure contact with each other.

19. A sheet feeding apparatus according to claim 11, wherein said second separation means includes an elastic member comprising a base member made of a foamed material and a rubber surface layer provided on said base member.

20. A image reading apparatus, comprising:

sheet supporting means for supporting sheets;

sheet delivery means for delivering the sheets from said sheet supporting means;

separation means including a rotational feeding member rotatable in a direction of sheet feeding and a counter-rotational member rotatable in a direction counter to the sheet feeding direction, said separating means separating said sheets delivered by said sheet delivery means;

an elastic member disposed in resilient contact with said rotational feeding member at a position upstream of a nip formed between said rotational feeding member and said counter-rotational member, so as to perform sheet separation in cooperation with said rotational feeding member; and reading means for reading an image on a separated sheet.

21. An image reading apparatus, comprising:

sheet supporting means for supporting sheets;

sheet delivery means for delivering the sheets from said sheet supporting means;

first separation means including a rotational feeding member rotatable in a direction of said sheet feeding and a counter-rotational member rotatable in a direction counter to the sheet feeding direction;

second separation means disposed in resilient contact with said rotational feeding member at a position upstream of a nip formed between said rotational feeding member and said counter-rotational member, so as to perform sheet separation in cooperation with said rotational feeding member;

wherein a level of first separating pressure exerted by said first separation means and a level of second separating pressure exerted by said second separation means are below a predetermined level of a separating pressure; and reading means for reading an image on a separated sheet.

* * * * *

UNITED STATES PATENT AND TRADEMARK OFFICE

CERTIFICATE OF CORRECTION

PATENT NO. : 5,769,411

DATED : June 23, 1998

INVENTOR(S) : TOMOHITO NAKAGAWA, ET AL.

It is certified that error appears in the above-identified patent and that said Letters Patent is hereby corrected as shown below:

COLUMN 2:

Line 4, "the" should read --of the--;
Line 20, "member;" should read --member--; and
Line 42, "a" should read --as--.

COLUMN 4:

Line 17, "surface" (second occurrence) should be deleted.

COLUMN 5:

Line 29, "sheep" should read --sheet-; and
Line 60, "by" should be deleted.

COLUMN 11:

Line 7, "$\lambda_4$" should read --$\ell_4$--;
Line 49, "$\lambda_1$ to $\lambda_4$" should read --$\ell_1$ to $\ell_4$--;
Line 57, "$\lambda_4$ and $\lambda_3$." should read --$\ell_4$ and $\ell_3$.--;
Line 61, "$\lambda_3$ and $\lambda_2$," should read --$\ell_3$ and $\ell_2$,--;

Line 64, "$\lambda_2$." should read --$\ell_2$--; and

Line 66, "in" should read --in a--.

UNITED STATES PATENT AND TRADEMARK OFFICE

CERTIFICATE OF CORRECTION

PATENT NO. : 5,769,411

DATED : June 23, 1998

INVENTOR(S) : TOMOHITO NAKAGAWA, ET AL.

It is certified that error appears in the above-identified patent and that said Letters Patent is hereby corrected as shown below:

COLUMN 13:

Line 18, "retarding" should read --a retarding--;
Line 41, "fed" should read --feed--; and
Line 49, "so as" should be deleted.

COLUMN 15:

Line 36, "member-rotatable" should read --member rotatable--.

Signed and Sealed this

Twenty-ninth Day of June, 1999

*Attest:*

Q. TODD DICKINSON

*Attesting Officer*

*Acting Commissioner of Patents and Trademarks*